US011649143B2

(12) United States Patent
Kanda et al.

(10) Patent No.: US 11,649,143 B2
(45) Date of Patent: May 16, 2023

(54) CRANE

(71) Applicant: TADANO LTD., Kagawa (JP)

(72) Inventors: Shinsuke Kanda, Kagawa (JP); Kazuma Mizuki, Kagawa (JP)

(73) Assignee: TADANO LTD., Kagawa (JP)

( * ) Notice: Subject to any disclaimer, the term of this patent is extended or adjusted under 35 U.S.C. 154(b) by 518 days.

(21) Appl. No.: 16/650,197

(22) PCT Filed: Sep. 28, 2018

(86) PCT No.: PCT/JP2018/036414
§ 371 (c)(1),
(2) Date: Mar. 24, 2020

(87) PCT Pub. No.: WO2019/066018
PCT Pub. Date: Apr. 4, 2019

(65) Prior Publication Data

US 2020/0262685 A1 Aug. 20, 2020

(30) Foreign Application Priority Data

Sep. 29, 2017 (JP) ..... JP2017-192193

(51) Int. Cl.
*B66C 13/06* (2006.01)
*B66C 13/22* (2006.01)

(52) U.S. Cl.
CPC ..... *B66C 13/066* (2013.01); *B66C 13/063* (2013.01); *B66C 13/22* (2013.01)

(58) Field of Classification Search
CPC ..... B66C 13/063; B66C 13/066; B66C 13/22
See application file for complete search history.

(56) References Cited

U.S. PATENT DOCUMENTS 5,832,730 A * 11/1998 Mizui ..... E02F 9/2207 91/361
2008/0275610 A1* 11/2008 Terashima ..... B66C 13/063 700/55

(Continued)

FOREIGN PATENT DOCUMENTS

JP 2016-160081 A 9/2016
WO WO 2011/119037 A1 9/2011

OTHER PUBLICATIONS

Jun. 4, 2021, European Search Report issued for related EP application No. 18863065.1.

(Continued)

*Primary Examiner* — Michael R Mansen
*Assistant Examiner* — Juan J Campos, Jr.
(74) *Attorney, Agent, or Firm* — Paratus Law Group, PLLC

(57) ABSTRACT

The resonant frequency ωx(n) of horizontal shaking of a suspended load W suspended from the distal end of a telescopic boom 9 via wire ropes 14·16 is calculated on the basis of the suspension length Lm(n)·Ls(n) of the wire ropes 14·16; the characteristic frequency ωy(n) in the raising and lowering direction of the telescopic boom 9 is calculated; and, in accordance with an operation for raising and lowering the telescopic boom 9, the filtering control signal Cd(n) of an actuator is generated in which a frequency component in a discretionary frequency range is attenuated at a discretionary ratio with reference to the resonant frequency ωx(n) of the suspended load W, and in which a frequency component in a discretionary frequency range is attenuated at a discretionary ratio with reference to the characteristic frequency ωy(n) in the raising and lowering direction of the telescopic boom 9.

4 Claims, 10 Drawing Sheets

(56) References Cited

U.S. PATENT DOCUMENTS

| | | | | |
|---|---|---|---|---|
| 2014/0067111 | A1 | 3/2014 | Vitovsky | |
| 2016/0194183 | A1* | 7/2016 | Kyllingstad | B66C 13/066 212/272 |

OTHER PUBLICATIONS

Dec. 11, 2018, International Search Report issued for related PCT Application No. PCT/JP2018/036414.
Dec. 11, 2018, International Search Opinion issued for related PCT Application No. PCT/JP2018/036414.

* cited by examiner

CRANE

CROSS REFERENCE TO PRIOR APPLICATION

This application is a National Stage Patent Application of PCT International Patent Application No. PCT/JP2018/036414 (filed on Sep. 28, 2018) under 35 U.S.C. §371, which claims priority to Japanese Patent Application No. 2017-192193 (filed on Sep. 29, 2017), which are all hereby incorporated by reference in their entirety.

TECHNICAL FIELD

The present invention relates to cranes. The present invention particularly relates to a crane that attenuates a resonance frequency component of a control signal.

BACKGROUND ART

Conventionally, in cranes, acceleration applied when a load is carried functions as a vibratory force to cause a vibration in the carried load as a simple pendulum which is a material point of the load suspended from a leading end of a wire rope or as a double pendulum whose fulcrum is a hook part. Moreover, besides the vibration caused by the simple pendulum or the double pendulum, there is another vibration when a load is carried by a crane provided with a telescopic boom, which is caused due to deflection of each structural component of the crane, such as the telescopic boom, a wire rope, or the like. The load suspended from the wire rope is carried while vibrating at the resonance frequency of the simple pendulum or the double pendulum and also vibrating at the natural frequencies of the telescopic boom in the luffing direction and/or in the swiveling direction, at the natural frequency of the wire rope during a stretching vibration caused by stretch of the wire rope, and/or the like.

In such a crane, the frequencies of vibrations caused during operation are different from one another depending on operational directions of the crane. On that matter, cranes have been known, which are configured to cancel out a vibration of a load effectively by applying, to a control signal for each actuator for moving components of a crane in each of the operational directions, a notch filter whose center frequency is a frequency of a vibration corresponding to the operational direction. For example, see a crane of Patent Literature (hereinafter, referred to as "PTL") 1).

The crane described in PTL 1 applies a notch filter to the frequency of the vibration expected to occur in each of the operational directions of the crane based on a vibration model of the crane. The crane controls the drive of a boom using a corrected speed signal obtained by applying the filter to a load-carrying signal for each of the actuators, so as to be capable of reducing the vibration of the carried load. However, the crane described in PTL 1 is disadvantageous in that the vibration or the like of the boom itself that is varied depending on the luffing angles of the boom cannot be reduced.

CITATION LIST

Patent Literature

PTL 1
Japanese Patent Application Laid-Open No. 2016-160081

SUMMARY OF INVENTION

Technical Problem

An object of the present invention is to provide a crane that can reduce a vibration that is caused in a load and is related to the resonance frequency of a horizontal swing, and a vibration that is caused in the load and is related to the natural frequency of a telescopic boom.

Solution to Problem

A crane of the present invention is a crane that generates a filtered control signal for an actuator, the filtered control signal being a control signal for the actuator in which a frequency component in any frequency range is attenuated at any rate, in which a resonance frequency of a swing of a load in a horizontal direction is computed based on a suspension length of a wire rope via which the load is suspended from a leading end of a telescopic boom, a natural frequency of the telescopic boom in a luffing direction is computed, and the filtered control signal for the actuator is generated according to a luffing manipulation of the telescopic boom, the filtered control signal being a signal in which a frequency component in any frequency range is attenuated at any rate with reference to the resonance frequency of the load and a frequency component in any frequency range is attenuated at any rate with reference to the natural frequency of the telescopic boom in the luffing direction.

The rate of attenuation of a frequency component in any frequency range with reference to the resonance frequency of the load and the rate of attenuation of a frequency component in any frequency range with reference to the natural frequency of the telescopic boom in the luffing direction are changed based on a ratio between a coefficient of a swing in the horizontal direction and a coefficient of a swing in the luffing direction, the coefficient of the swing in the horizontal direction being based on a luffing angle of the telescopic boom and the resonance frequency and the coefficient of the swing in the luffing direction being based on the luffing angle of the telescopic boom and the natural frequency of the telescopic boom in the luffing direction.

Also provided is a crane that generates a filtered control signal for an actuator, the filtered control signal being a control signal for the actuator in which a frequency component in any frequency range is attenuated at any rate, in which a resonance frequency of a swing of a load in a horizontal direction is computed based on a suspension length of a wire rope via which the load is suspended from a leading end of a telescopic boom, a natural frequency of the telescopic boom in a swiveling direction is computed, and the filtered control signal for the actuator is generated according to a swivel manipulation of the telescopic boom, the filtered control signal being a signal in which a frequency component in any frequency range is attenuated at any rate with reference to the resonance frequency of the load and a frequency component in any frequency range is attenuated at any rate with reference to the natural frequency of the telescopic boom in the swiveling direction.

The rate of attenuation of a frequency component in any frequency range with reference to the resonance frequency of the load and the rate of attenuation of a frequency component in any frequency range with reference to the natural frequency of the telescopic boom in the swiveling direction are changed based on a ratio between a coefficient of a swing in the horizontal direction and a coefficient of a swing in a swiveling direction, the coefficient of the swing in the horizontal direction being based on a luffing angle of the telescopic boom and the resonance frequency and the coefficient of the swing in the swiveling direction being based on the luffing angle of the telescopic boom and the natural frequency of the telescopic boom in the swiveling direction.

Advantageous Effects of Invention

According to the present invention, a specific frequency component in a control signal is attenuated, so that a vibration having the specific frequency component among vibrations caused by an actuator performing luffing operation is not transmitted to a telescopic boom. It is thus possible to reduce the vibration that is caused in a load and is related to the resonance frequency of a horizontal swing, and the vibration that is caused in the load and is related to the natural frequency of the telescopic boom.

According to the present invention, the frequency component of the vibration that is easily excited by the luffing operation is efficiently attenuated by changing, according to luffing angles, the rate of attenuation of the frequency component of the vibration. It is thus possible to reduce the vibration that is caused in the load and is related to the resonance frequency of the horizontal swing, and the vibration that is caused in the load and is related to the natural frequency of the telescopic boom.

According to the present invention, a specific frequency component in a control signal is attenuated, so that a vibration having the specific frequency component among vibrations caused by an actuator performing swivel operation is not transmitted to the telescopic boom. It is thus possible to reduce the vibration that is caused in the load and is related to the resonance frequency of the horizontal swing, and the vibration that is caused in the load and is related to the natural frequency of the telescopic boom.

According to the present invention, the frequency component of the vibration that is easily excited by the swivel operation is efficiently attenuated by changing, according to luffing angles, the rate of attenuation of the frequency component of the vibration. It is thus possible to reduce the vibration that is caused in the load and is related to the resonance frequency of the horizontal swing, and the vibration that is caused in the load and is related to the natural frequency of the telescopic boom.

BRIEF DESCRIPTION OF DRAWINGS

FIGS. 6A and 6B illustrate notch filters for a vertical swing and a lateral swing of a load, in which FIG. 6A is a graph illustrating the magnitudes of the lateral swing and the vertical swing of the load in the cases of a large luffing angle and a small luffing angle, and FIG. 6B is a graph illustrating notch depths and notch widths of the notch filters applied in the cases of the large luffing angle and the small luffing angle;

FIGS. 7A and 7B illustrate luffing operation of a boom, in which FIG. 7A is a schematic side view illustrating the luffing operation in a luffed-up state, and FIG. 7B is a schematic side view illustrating the luffing operation of the crane in a luffed-down state;

FIGS. 8A and 8B illustrate swivel operation, in which FIG. 8A is a schematic plan view illustrating the swivel operation in the luffed-down state, and FIG. 8B is a schematic plan view illustrating the swivel operation in the luffed-up state;

DESCRIPTION OF EMBODIMENTS

Hereinafter, a description will be given of crane 1 according to Embodiment 1 of the present invention with reference to FIGS. 1 and 2. Note that, although the present embodiment will be described in relation to a mobile crane (rough terrain crane) as crane 1, crane 1 may also be a truck crane or the like.

Figure 1:
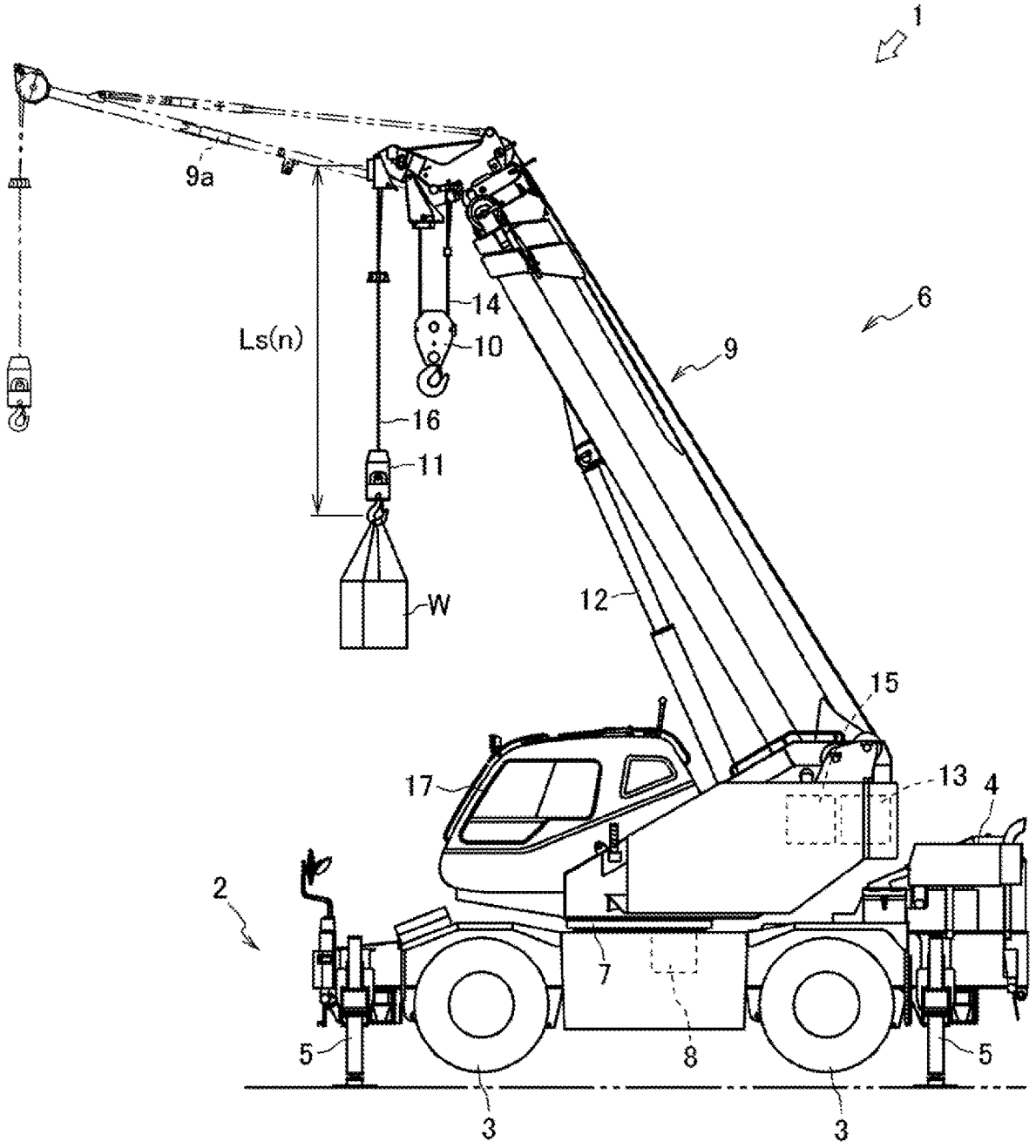
FIG. 1 is a side view illustrating an entire configuration of a crane.

As illustrated in FIG. 1, crane 1 is a mobile crane that can be moved to an unspecified place. Crane 1 includes vehicle 2 and crane device 6.

Vehicle 2 carries crane device 6. Vehicle 2 includes a plurality of wheels 3, and travels using engine 4 as a power source. Vehicle 2 is provided with outriggers 5. Outriggers 5 are composed of projecting beams hydraulically extendable on both sides of vehicle 2 in the width direction and hydraulic jack cylinders extendable in the direction vertical to the ground. Vehicle 2 can extend a workable region of crane 1 by extending outriggers 5 in the width direction of vehicle 2 and bringing the jack cylinders into contact with the ground.

Crane device 6 hoists up load W with a wire rope. Crane device 6 includes swivel base 7, telescopic boom 9, jib 9*a*, main hook block 10, sub hook block 11, hydraulic luffing cylinder 12, main winch 13, main wire rope 14, sub winch 15, sub wire rope 16, cabin 17, and the like.

Swivel base 7 allows crane device 6 to swivel. Swivel base 7 is disposed on a frame of vehicle 2 via an annular bearing. Swivel base 7 is configured to be rotatable around the center of the annular bearing serving as a rotational center. Swivel base 7 is provided with hydraulic swivel motor 8 that is an actuator. Swivel base 7 is configured to swivel in one and the other directions by hydraulic swivel motor 8.

Figure 2:
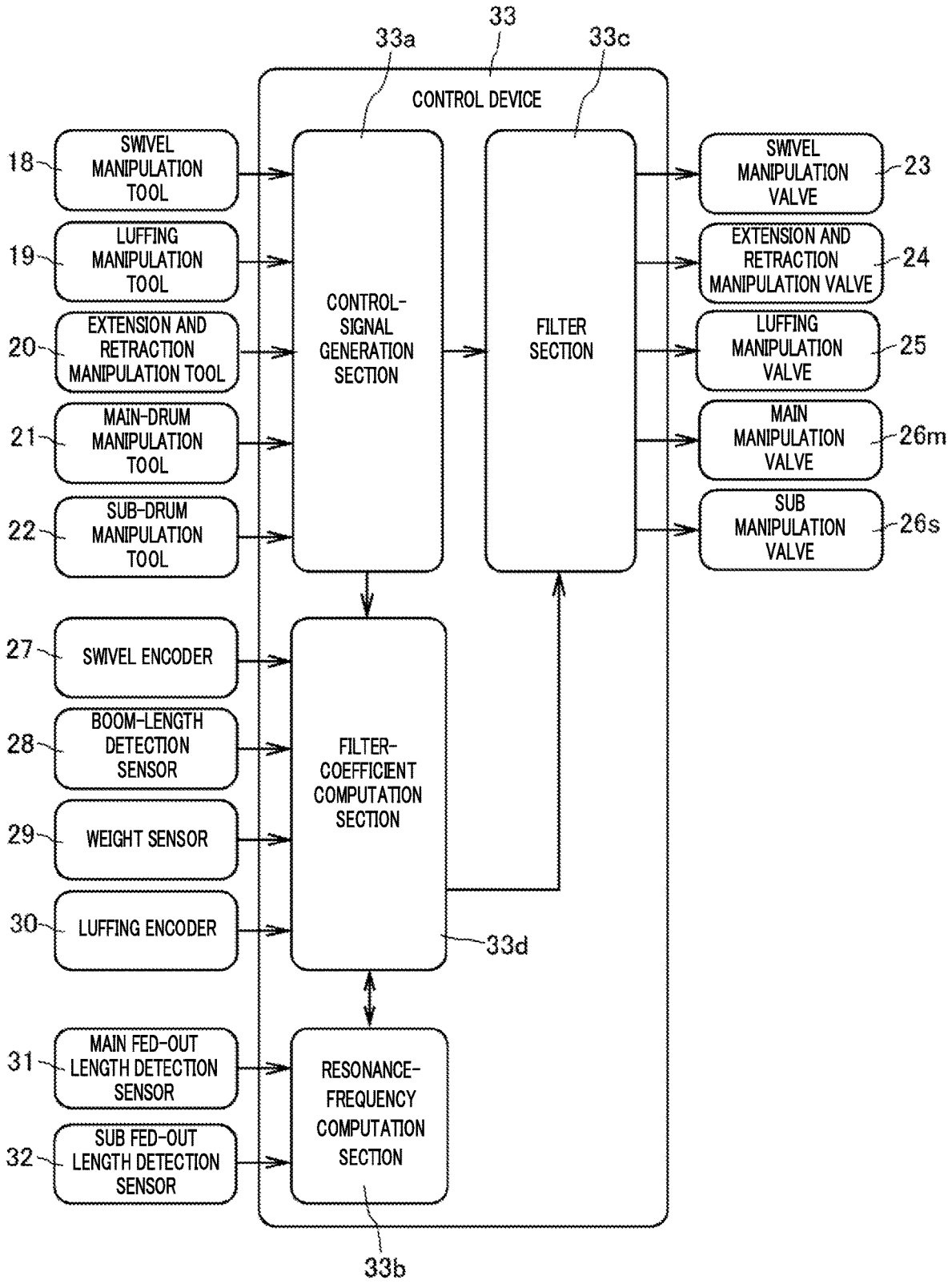
FIG. 2 is a block diagram illustrating a control configuration of the crane.

Hydraulic swivel motor 8 as the actuator is manipulated to rotate by using swivel manipulation valve 23 that is an electromagnetic proportional switching valve (see FIG. 2). Swivel manipulation valve 23 can control the flow rate of the operating oil supplied to hydraulic swivel motor 8 such that the flow rate is any flow rate. That is, swivel base 7 is configured to be controllable via hydraulic swivel motor 8 manipulated to rotate by using swivel manipulation valve 23 such that the swivel speed of swivel base 7 is any swivel speed. Swivel base 7 is provided with swivel encoder 27 (see FIG. 2) that detects the swivel position (angle) and swivel speed of swivel base 7.

Telescopic boom 9 supports the wire rope such that load W can be hoisted. Telescopic boom 9 is composed of a plurality of boom members. Telescopic boom 9 is configured to be extendible and retractable in the axial direction thereof by moving the boom members by a hydraulic extension and retraction cylinder (not illustrated) that is an actuator. The base end of a base boom member of telescopic boom 9 is disposed on a substantial center of swivel base 7 such that telescopic boom 9 is swingable.

The hydraulic extension and retraction cylinder (not illustrated) as the actuator is manipulated to extend and retract by using extension and retraction manipulation valve 24 that is an electromagnetic proportional switching valve (see FIG. 2). Extension and retraction manipulation valve 24 can control the flow rate of the operating oil supplied to the hydraulic extension and retraction cylinder such that the flow rate is any flow rate. That is, telescopic boom 9 is configured to be controllable by extension and retraction manipulation valve 24 such that telescopic boom 9 has any boom length. Telescopic boom 9 is provided with boom-length detection sensor 28 that detects the extension/retraction amount of telescopic boom 9 and weight sensor 29 (see FIG. 2) that detects weight Wt of load W.

Jib 9*a* extends the lifting height and the operating radius of crane device 6. Jib 9*a* is held by a jib supporting part disposed in the base boom member of telescopic boom 9 such that the attitude of jib 9*a* is along the base boom member. The base end of jib 9*a* is configured to be able to be coupled to a jib supporting part of a top boom member.

Main hook block 10 and sub hook block 11 are for suspending load W. Main hook block 10 is provided with a plurality of hook sheaves around which main wire rope 14 is wound, and a main hook for suspending load W. Sub hook block 11 is provided with a sub hook for suspending load W.

Hydraulic luffing cylinder 12 as an actuator luffs up or down telescopic boom 9, and holds the attitude of telescopic boom 9. Hydraulic luffing cylinder 12 is composed of a cylinder part and a rod part. In hydraulic luffing cylinder 12, an end of the cylinder part is swingably coupled to swivel base 7, and an end of the rod part is swingably coupled to the base boom member of telescopic boom 9.

Hydraulic luffing cylinder 12 as the actuator is manipulated to extend or retract by using luffing manipulation valve 25 (see FIG. 2) that is an electromagnetic proportional switching valve. Luffing manipulation valve 25 can control the flow rate of the operating oil supplied to hydraulic luffing cylinder 12 such that the flow rate is any flow rate. That is, telescopic boom 9 is configured to be controllable by luffing manipulation valve 25 such that telescopic boom 9 is luffed at any luffing speed. Telescopic boom 9 is provided with luffing encoder 30 (see FIG. 2) that detects the luffing angle of telescopic boom 9.

Main winch 13 and sub winch 15 wind up (reel up) and feed out (release) main wire rope 14 and sub wire rope 16, respectively. Main winch 13 has a configuration in which a main drum around which main wire rope 14 is wound is rotated by using a main hydraulic motor (not illustrated) that is an actuator, and sub winch 15 has a configuration in which a sub drum around which sub wire rope 16 is wound is rotated by using a sub hydraulic motor (not illustrated) that is an actuator.

The main hydraulic motor as the actuator is manipulated to rotate by using main manipulation valve 26*m* (see FIG. 2) that is an electromagnetic proportional switching valve. Main manipulation valve 26*m* can control the flow rate of the operating oil supplied to the main hydraulic motor such that the flow rate is any flow rate. That is, main winch 13 is configured to be controllable by main manipulation valve 26*m* such that the winding-up and feeding-out rate is any rate. Similarly, sub winch 15 is configured to be controllable by sub manipulation valve 26*s* (see FIG. 2) that is an electromagnetic proportional switching valve such that the winding-up and feeding-out rate is any rate. Main winch 13 is provided with main fed-out length detection sensor 31. Similarly, sub winch 15 is provided with sub fed-out length detection sensor 32.

Cabin 17 covers an operator compartment. Cabin 17 is mounted on swivel base 7. Cabin 17 is provided with an operator compartment which is not illustrated. The operator compartment is provided with manipulation tools for traveling manipulation of vehicle 2, and swivel manipulation tool 18, luffing manipulation tool 19, extension and retraction manipulation tool 20, main-drum manipulation tool 21, sub-drum manipulation tool 22, and the like for manipulating crane device 6 (see FIG. 2). Swivel manipulation tool 18 can control hydraulic swivel motor 8 by manipulating swivel manipulation valve 23. Luffing manipulation tool 19 can control hydraulic luffing cylinder 12 by manipulating luffing manipulation valve 25. Extension and retraction manipulation tool 20 can control the hydraulic extension and retraction cylinder by manipulating extension and retraction manipulation valve 24. Main-drum manipulation tool 21 can control the main hydraulic motor by manipulating main manipulation valve 26*m*. Sub-drum manipulation tool 22 can control the sub hydraulic motor by manipulating sub manipulation valve 26*s*.

Crane 1 configured as described above is capable of moving crane device 6 to any position by causing vehicle 2 to travel. Crane 1 is also capable of extending the lifting height and/or the operating radius of crane device 6, for example, by luffing up telescopic boom 9 to any luffing angle with hydraulic luffing cylinder 12 by manipulation of luffing manipulation tool 19, and/or by extending telescopic boom 9 to any boom length by manipulation of extension and retraction tool 20. Crane 1 is also capable of carrying load W by hoisting up load W with sub-drum manipulation tool 22 and/or the like, and causing swivel base 7 to swivel by manipulation of swivel manipulation tool 18.

Control device 33 controls the actuators of crane 1 via the manipulation valves as illustrated in FIG. 2. Control device 33 includes control-signal generation section 33*a*, resonance-frequency computation section 33*b*, filter section 33*c*, and filter-coefficient computation section 33*d*. Control device 33 is provided inside cabin 17. Substantively, control device 33 may have a configuration in which a CPU, ROM, RAM, HDD, and/or the like are connected to one another via a bus, or may be configured to consist of a one-chip LSI or the like. Control device 33 stores therein various programs and/or data in order to control the operation of control-signal generation section 33*a*, resonance-frequency computation section 33*b*, filter section 33*c*, and filter-coefficient computation section 33*d*.

Control-signal generation section 33*a* is a part of control device 33, and generates a control signal that is a speed command for each of the actuators. Control-signal generation section 33*a* is configured to obtain the manipulation amount of each of swivel manipulation tool 18, luffing manipulation tool 19, extension and retraction manipulation tool 20, main-drum manipulation tool 21, sub-drum manipulation tool 22, and the like, and generate control signal C(1) for swivel manipulation tool 18, control signal C(2) for luffing manipulation tool 19, . . . , and/or control signal C(n) (hereinafter, the control signals are simply collectively referred to as "control signal C(n)," where "n" denotes any number). Control-signal generation section 33*a* is also configured to generate control signal C(na) for performing an automatic control (e.g., automatic stop, automatic carriage, or the like) without manipulation of any of the manipulation tools (without manual control), or control signal C(ne) for performing an emergency stop control based on an emergency stop manipulation of any of the manipulation tools when telescopic boom 9 approaches a restriction area of the working region and/or when control-signal generation section 33*a* obtains a specific command.

Resonance-frequency computation section 33*b* is a part of control device 33, and computes resonance frequency ωx(n) of load W suspended from main wire rope 14 or sub wire rope 16 to function as a simple pendulum. Resonance-frequency computation section 33*b* obtains the luffing angle of telescopic boom 9 obtained by filter-coefficient computation section 33*d*, the fed-out amount of corresponding main wire rope 14 or sub wire rope 16 from main fed-out length detection sensor 31 or sub fed-out length detection sensor 32, and the number of parts of line of main hook block 10 from a safety device (not illustrated) in the case of using main hook block 10.

Further, resonance-frequency computation section 33*b* is configured to compute suspension length Lm(n) of main wire rope 14 from a position (suspension position) in a sheave at which main wire rope 14 leaves the sheave to the hook block or suspension length Ls(n) of sub wire rope 16 from a position (suspension position) in a sheave at which sub wire rope 16 leaves the sheave to the hook block (see FIG. 1) based on the obtained luffing angle of telescopic boom 9, the fed-out amount of main wire rope 14 or sub wire rope 16, and the number of parts of line of main hook block 10 in the case of using main hook block 10, and compute resonance frequency $\omega x(n)=\sqrt{(g/Ln)}$ (Equation 1) based on gravitational acceleration g and suspension length L(n) that is suspension length Lm(n) of main wire rope 14 or suspension length Ls(n) of sub wire rope 16. Note that, resonance frequency ωx(n) may also be computed using a pendulum length (a length of the wire rope from the position at which the wire rope leaves the sheave to center of gravity G of load W) instead of suspension length L (n).

In addition, telescopic boom 9 to which, at its leading end, the weight of load W is applied can approximate to a cantilever to which, its free end, a weight is attached. Thus, resonance-frequency computation section 33*b* is configured to compute natural frequency ωy(n) of telescopic boom 9 interpreted as the cantilever. Resonance-frequency computation section 33*b* is configured to compute natural frequency ωy(n) of telescopic boom 9 based on the elastic modulus, the second moment of area, and the own weight of the cantilever stored in advance, and the extension/retraction amount of telescopic boom 9 and the weight of load W (including the weight of the hook block) obtained from filter-coefficient computation section 33*d*. Further, resonance-frequency computation section 33*b* is configured to compute not only natural frequency ωy(n) of telescopic boom 9 in the luffing direction but also natural frequency ωz(n) of telescopic boom 9 in the swiveling direction. In addition, the method for computing natural frequency ωy(n) of telescopic boom 9 in the luffing direction and natural frequency ωz(n) of telescopic boom 9 in the swiveling direction is not limited to the above-described method, by may also be a modal analysis or eigenvalue analysis.

Filter section 33*c* is a part of control device 33, and generates notch filters F(1), F(2), . . . , and/or F(n) for attenuating specific frequency regions of control signals C(1), C(2), . . . , and/or C(n) (hereinafter, simply referred to as "notch filter F(n)," where n is any number) and applies notch filter F(n) to control signal C(n). Filter section 33*c* is configured to obtain control signals C(1), C(2), . . . , and/or C(n) from control-signal generation section 33*a*, apply notch filter F(1) to control signal C(1) to generate filtered control signal Cd(1) that is control signal C(1) in which a frequency component in any frequency range is attenuated with reference to resonance frequency w(1) at any rate, apply notch filter F(2) to control signal C(2) to generate filtered control signal Cd(2), . . . , and/or apply notch filter F(n) to control signal C(n) to generate filtered control signal Cd(n) that is control signal C(n) in which a frequency component in any frequency range is attenuated with reference to resonance frequency ωx(n) and one of natural frequency ωy(n) and natural frequency ωz(n) at any rate (hereinafter, such filtered control signals are simply referred to as "filtered control signal Cd(n)," where n is any number).

Filter section 33*c* is configured to transmit filtered control signal Cd(n) to a corresponding manipulation valve among swivel manipulation valve 23, extension and retraction manipulation valve 24, luffing manipulation valve 25, main manipulation valve 26*m*, and sub manipulation valve 26*s*. That is, control device 33 is configured to be able to control hydraulic swivel motor 8, hydraulic luffing cylinder 12, the hydraulic extension and retraction cylinder (not illustrated), the main hydraulic motor (not illustrated), and the sub hydraulic motor (not illustrated) that are the actuators via the respective manipulation valves.

Filter-coefficient computation section 33*d* is a part of control device 33, and computes, based on the operational state of crane 1, center frequency coefficient $\omega x_n$, notch width coefficient ζx, and notch depth coefficient δx of transfer function H(s) of notch filter Fx(n) whose center frequency we is resonance frequency ωx(n) of load W (see Equation 2). Filter-coefficient computation section 33*d* is configured to compute notch width coefficient and notch depth coefficient δx corresponding to a manipulation state, and compute center frequency coefficient $\omega x_n$ corresponding to obtained resonance frequency ωx(n). Further, filter-coefficient computation section 33*d* computes, based on the state of crane 1, center frequency coefficient $\omega y_n$, notch width coefficient ζy, and notch depth coefficient δy of transfer function H(s) of notch filter Fy(n) whose center frequency ωc is natural frequency ωy(n) of telescopic boom 9 in the luffing direction. Filter-coefficient computation section 33*d* is configured to compute notch width coefficient ζy and notch depth coefficient δy corresponding to the manipulation state, and compute center frequency coefficient $\omega y_n$ corresponding to obtained natural frequency ωy(n). Similarly, filter-coefficient computation section 33*d* computes, based on the operational state of crane 1, center frequency coefficient $\omega c_n$, notch width coefficient ζz, and notch depth coefficient δn related to transfer function H(s) of notch filter Fz(n) whose center frequency ωc is natural frequency ωz(n) of telescopic boom 9 in the swiveling direction. Further, filter-coefficient computation section 33*d* is configured to compute lateral swing coefficient Kx and vertical swing coefficient Ky or swiveling swing coefficient Kz, which will be described later, and to determine the ratio between the coefficients of notch filter Fx(n) corresponding to the lateral swing and the coefficients of notch filter Fy(n) corresponding to the vertical swing or the coefficients of notch filter Fz(n) corresponding to the swiveling swing.

Notch filter F(n) will be described with reference to FIGS. 3 and 4. Here, a description will be give of notch filter Fx(n) for reducing the swing at resonance frequency ωx(n) of load W. Notch filters F(n) for reducing the swings caused at natural frequency ωy(n) of telescopic boom 9 in the luffing direction and natural frequency ωz(n) of telescopic boom 9 in the swiveling direction have configurations similar to that of notch filter Fx(n) and, therefore, descriptions thereof are omitted. Notch filter F(n) is a filter with any center frequency for giving steep attenuation to control signal C(n).

Figure 3:
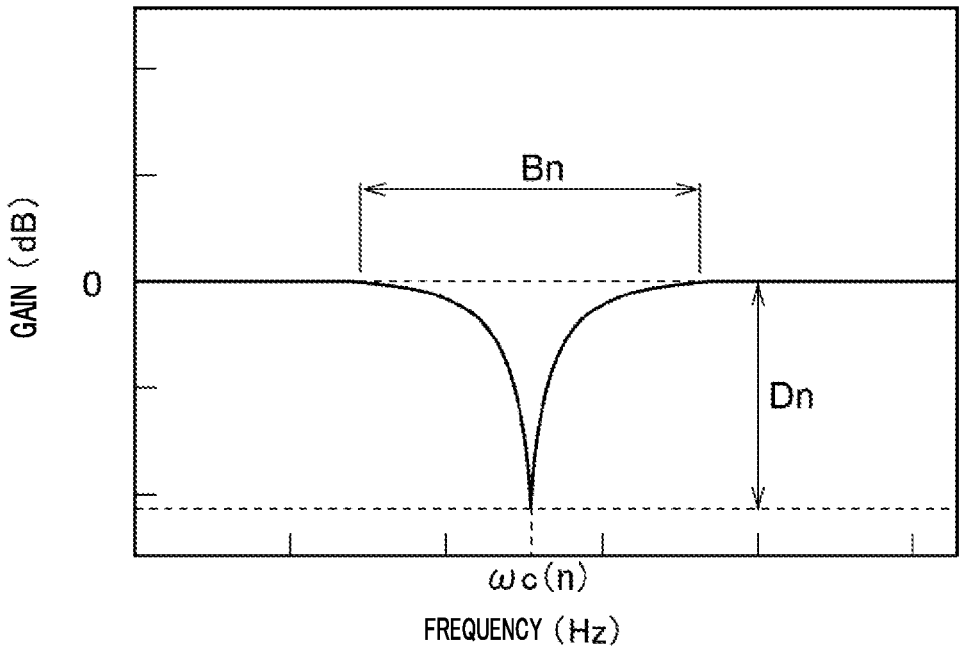
FIG. 3 illustrates a graph indicating frequency characteristics of a notch filter.

As illustrated in FIG. 3, notch filter Fx(n) is a filter having frequency characteristics by which a frequency component in notch width Bn that is any frequency range centrally including any center frequency ωc is attenuated at notch depth Dn that is an attenuation rate of any frequency at center frequency ωc. That is, the frequency characteristics of notch filter F(n) are set based on center frequency ωc, notch width Bn, and notch depth Dn.

Notch filter F(n) has transfer function H(s) indicated by following Equation 2.

[1]

$$H(s) = \frac{s^2 + 2\delta \times \zeta \times \omega \times_n s + \omega \times n^2}{s^2 + 2\zeta \times \omega \times_n s + \omega \times n^2} \quad \text{(Equation 2)}$$

In Equation 2, "$\omega x_n$" denotes center frequency coefficient $\omega x_n$ corresponding to center frequency ωc of notch filter Fx(n), "ζx" denotes the notch width coefficient corresponding to notch width Bn, and "δx" denotes the notch depth coefficient corresponding to notch depth Dn. In notch filter Fx(n), changing center frequency coefficient $\omega x_n$ changes center frequency ωc of notch filter Fx(n), changing notch width coefficient ζx changes notch width Bn of notch filter Fx(n), and changing notch depth coefficient δx changes notch depth Dn of notch filter Fx(n).

The greater notch width coefficient ζx is set, the greater the notch width Bn is set. In an input signal to which notch filter F(n) is applied, the attenuated frequency range with respect to center frequency ωc is thus set by notch width coefficient ζx.

Notch depth coefficient ωx of from 0 to 1 is set.

Figure 4:
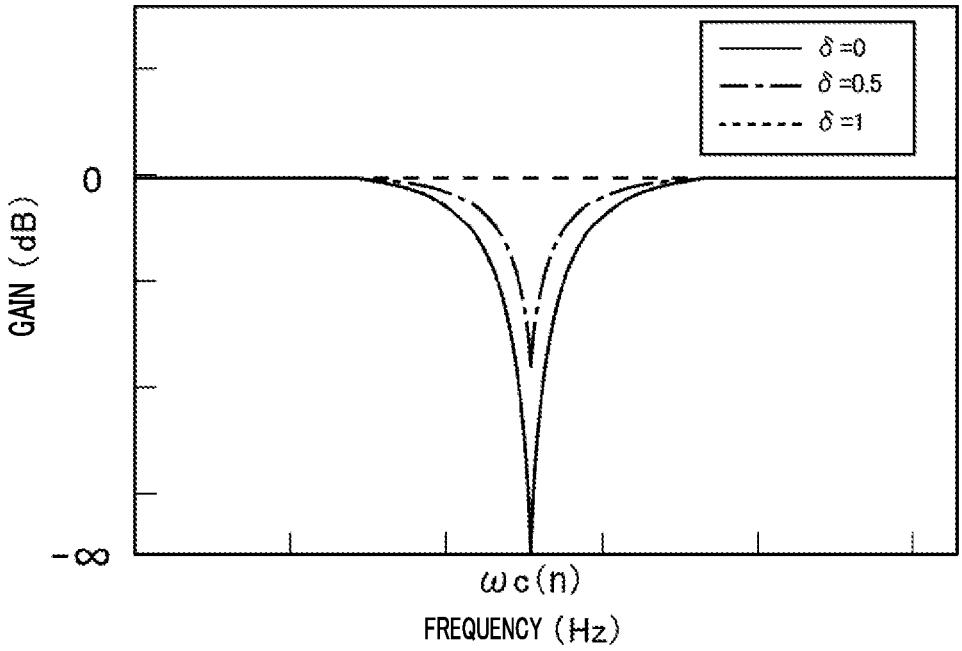
FIG. 4 illustrates a graph indicating frequency characteristics of the notch filter with different notch depth coefficients.

As illustrated in FIG. 4, notch filter Fx(n) achieves a gain characteristic of −∞ dB at center frequency ωc in the case of notch depth coefficient δx=0. Notch filter Fx(n) thus achieves the greatest attenuation at center frequency ωc in the input signal to which notch filter Fx(n) is applied. That is, notch filter Fx(n) outputs the input signal while maximizing the attenuation in the input signal in accordance with the frequency characteristics of notch filter Fx(n).

Notch filter Fx(n) achieves a gain characteristic of 0 dB at center frequency ωc in the case of notch depth coefficient δx=1. Notch filter Fx(n) thus does not attenuate any frequency component of the input signal to which notch filter Fx(n) is applied. That is, notch filter Fx(n) outputs the input signal as input.

As for any manipulation signal, in the present embodiment, control-signal generation section 33*a* of control device 33 is connected to swivel manipulation tool 18, luffing manipulation tool 19, extension and retraction manipulation tool 20, main-drum manipulation tool 21, and sub-drum manipulation tool 22 as illustrated in FIG. 2, and can generate control signal C(n) according to the manipulation amount (manipulation signal) of each of swivel manipulation tool 18, luffing manipulation tool 19, main-drum manipulation tool 21, and sub-drum manipulation tool 22.

Resonance-frequency computation section 33*b* of control device 33 is connected to main fed-out length detection sensor 31, sub fed-out length detection sensor 32, filter-coefficient computation section 33*d*, and the safety device which is not illustrated, and can compute suspension length Lm(n) of main wire rope 14 or suspension length Ls(n) of sub wire rope 16.

In addition, resonance-frequency computation section 33*b* of control device 33 is connected to filter-coefficient computation section 33*d*, and obtains the extension/retraction amount of telescopic boom 9, the weight of load W, so as to be capable of computing natural frequency ωy(n) in the luffing direction and natural frequency ωz(n) in the swiveling direction based on the elastic modulus, the second moment of area, and the own weight of the cantilever as stored in advance.

Filter section 33*c* of control device 33 is connected to control-signal generation section 33*a*, so as to be capable of obtaining control signal C(n). Filter section 33*c* is also connected to swivel manipulation valve 23, extension and retraction manipulation valve 24, luffing manipulation valve 25, main manipulation valve 26*m*, and sub manipulation valve 26*s*, and can transmit filtered control signal Cd(n) corresponding to each of swivel manipulation valve 23, extension and retraction manipulation valve 24, luffing manipulation valve 25, main manipulation valve 26*m*, and sub manipulation valve 26*s*. Filter section 33*c* is also connected to filter-coefficient computation section 33*d*, so as to be capable of obtaining center frequency coefficient $\omega x_n$, notch width coefficient ζx, notch depth coefficient δx, center frequency coefficient $\omega y_n$, notch width coefficient ζy, and notch depth coefficient δy, center frequency coefficient $\omega c_n$, notch width coefficient ζz, and notch depth coefficient δz.

Filter-coefficient computation section 33*d* of control device 33 is connected to swivel encoder 27, boom-length detection sensor 28, weight sensor 29, and luffing encoder 30, so as to be capable of obtaining the swivel position of swivel base 7, the boom length, and the luffing angle, and weight Wt of load W. Filter-coefficient computation section 33*d* is also connected to control-signal generation section 33*a*, so as to be capable of obtaining control signal C(n). Filter-coefficient computation section 33*d* is also connected to resonance-frequency computation section 33*b*, so as to be capable of obtaining suspension length Lm(n) of main wire rope 14 and suspension length Ls(n) of sub wire rope 16 (see FIG. 1), resonance frequency ωx(n), natural frequency ωy(n) of telescopic boom 9 in the luffing direction, and natural frequency ωz(n) of telescopic boom 9 in the swiveling direction.

Control device 33 generates, at control-signal generation section 33*a*, control signal C(n) corresponding to each of swivel manipulation tool 18, luffing manipulation tool 19, extension and retraction manipulation tool 20, main-drum manipulation tool 21, and sub-drum manipulation tool 22 based on the manipulation amount of the manipulation tool.

Further, control device 33 computes, at resonance-frequency computation section 33*b*, resonance frequency ωx(n), natural frequency ωy(n), and natural frequency ωz(n). Control device 33 also computes center frequency coefficient $\omega x_n$, notch width coefficient ζx, and notch depth coefficient δx of notch filter Fx(n) whose center frequency ωc is resonance frequency ωx(n) computed by resonance-frequency computation section 33*b*. Control device 33 also computes center frequency coefficient $\omega y_n$, notch width coefficient ζy, and notch depth coefficient δy of notch filter Fy(n) whose center frequency we is natural frequency ωy(n) computed by resonance-frequency computation section 33*b*, and computes center frequency coefficient $\omega c_n$, notch width coefficient ζz, and notch depth coefficient δz of notch filter Fz(n) whose center frequency ωc is natural frequency ωz(n).

Figure 5:
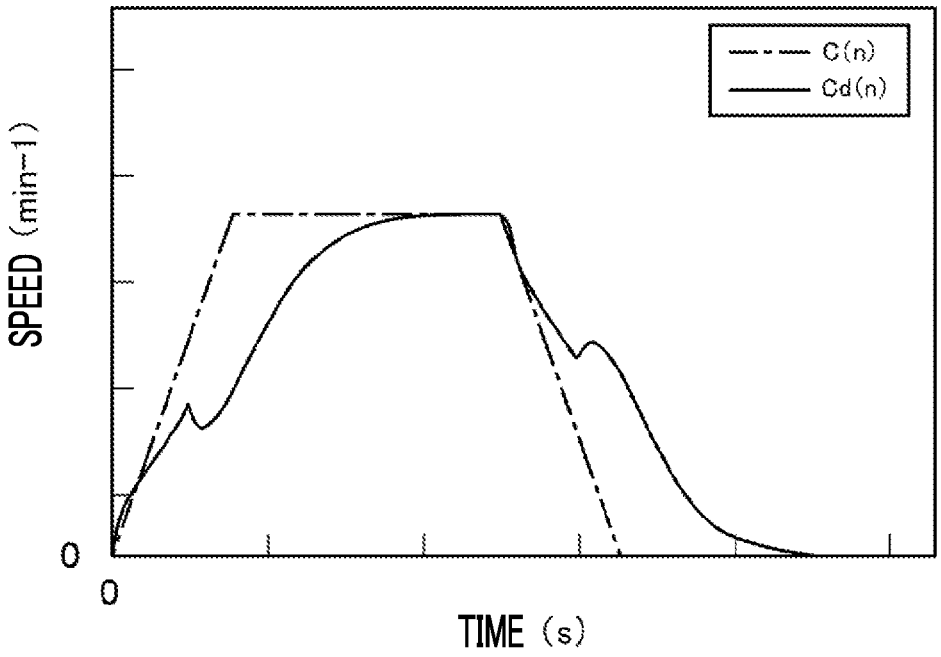
FIG. 5 illustrates a graph indicating a control signal for a swivel manipulation and a filtered control signal to which the notch filter is applied.

As illustrated in FIG. 5, control device 33 generates filtered control signal Cd(n) at filter section 33*c* by applying, to control signal C(n), at least one notch filter F(n) from among notch filter Fx(n) in which center frequency coefficient $\omega x_n$, notch width coefficient ζx, and notch depth coefficient δx are applied, notch filter Fy(n) in which center frequency coefficient $\omega y_n$, notch width coefficient and notch depth coefficient δy are applied, and notch filter Fz(n) in which center frequency coefficient $\omega c_n$, notch width coefficient ζz and notch depth coefficient δz are applied. Since at least one frequency component from among resonance frequency ωx(n), natural frequency ωy(n), and natural frequency ωz(n) is attenuated in filtered control signal Cd(n) to which notch filter F(n) is applied, filtered control signal Cd(n) exhibits a slower rise than control signal C(n) does and the time taken for operation to be finished is greater in the case of filtered control signal Cd(n) than in the case of control signal C(n).

Specifically, in any of the actuators controlled by filtered control signal Cd(n) to which notch filter F(n) with notch depth coefficient δx, δy, δz close to 0 (notch depth Dn is deep) is applied, the operational reaction in response to the manipulation of the manipulation tool is slower and the manipulability is lower than in a case where the actuator is controlled by filtered control signal Cd(n) to which notch filter F(n) with notch depth coefficient δx, δy, δz close to 1 (notch depth Dn is shallow) is applied, or in a case where the actuator is controlled by control signal C(n) to which notch filter F(n) is not applied. In other words, when crane 1 is controlled by filtered control signal Cd(n) to which notch filter F(n) is applied, a movable part is inertially driven in a moving direction by an amount corresponding to notch depth coefficient δx, δy, δz until the movable part stops after a stop manipulation with the manipulation tool is performed.

Further, in any of the actuators controlled by filtered control signal Cd(n) to which notch filter F(n) with notch width coefficient ζx, ζy, ζz being relatively greater than a standard value (notch width Bn is relatively great) is applied, the operational reaction in response to the manipulation of the manipulation tool is slower and the manipulability is lower than in a case where the actuator is controlled by filtered control signal Cd(n) to which notch filter F(n) with notch width coefficient ζx, ζy, ζz being relatively smaller than the standard value (notch width Bn is relatively narrow) is applied, or in the case where the actuator is controlled by control signal C(n) to which notch filter F(n) is not applied. In other words, when crane 1 is controlled by filtered control signal Cd(n) to which notch filter F(n) is applied, a movable part is inertially driven in a moving direction by an amount corresponding to notch width coefficient ζx, ζy, ζz until the movable part stops after a stop manipulation with the manipulation tool is performed.

On the occasion of luffing operation of telescopic boom 9, control device 33 computes, at filter-coefficient computation section 33*d*, resonance frequency ωx(n) determined based on suspension length L(n) of the wire rope, and natural frequency ωy(n) in the luffing direction and natural frequency ωz(n) in the swiveling direction for the extension/retraction amount of telescopic boom 9 at that time. Control device 33 computes, at filter-coefficient computation section 33*d*, below-described lateral swing coefficient Kx and vertical swing coefficient Ky, or, lateral swing coefficient Kx and swiveling swing coefficient Kz based on the luffing angle detected by luffing encoder 30 (see FIG. 2), resonance frequency ωx(n), and natural frequency ωy(n) or natural frequency ωz(n). Further, filter-coefficient computation section 33*d* computes, based on the ratio between lateral swing coefficient Kx and vertical swing coefficient Ky, notch depth coefficient δx of notch filter Fx(n) whose center frequency we is resonance frequency ωx(n) and notch depth coefficient δy of notch filter Fy(n) whose center frequency we is natural frequency ωy(n). Further, filter-coefficient computation section 33*d* computes, based on the ratio between lateral swing coefficient Kx and swiveling swing coefficient Kz, notch depth coefficient δx of notch filter Fx(n) whose center frequency we is resonance frequency ωx(n) and notch depth coefficient δz of notch filter Fz(n) whose center frequency we is natural frequency ωz(n).

With reference to FIGS. 6 and 7, a description will be given of setting notch depth coefficient δx of notch filter Fx(n) for reducing the swing (lateral swing) at resonance frequency ωx(n) of load W and notch depth coefficient δy of notch filter Fy(n) for reducing the swing (vertical swing) at natural frequency ωy(n) of telescopic boom 9 in the luffing direction. Note that, the description is given on the assumption that load W is suspended using sub wire rope 16 and the boom length of telescopic boom 9 is constant during the luffing operation.

Figure 6A:
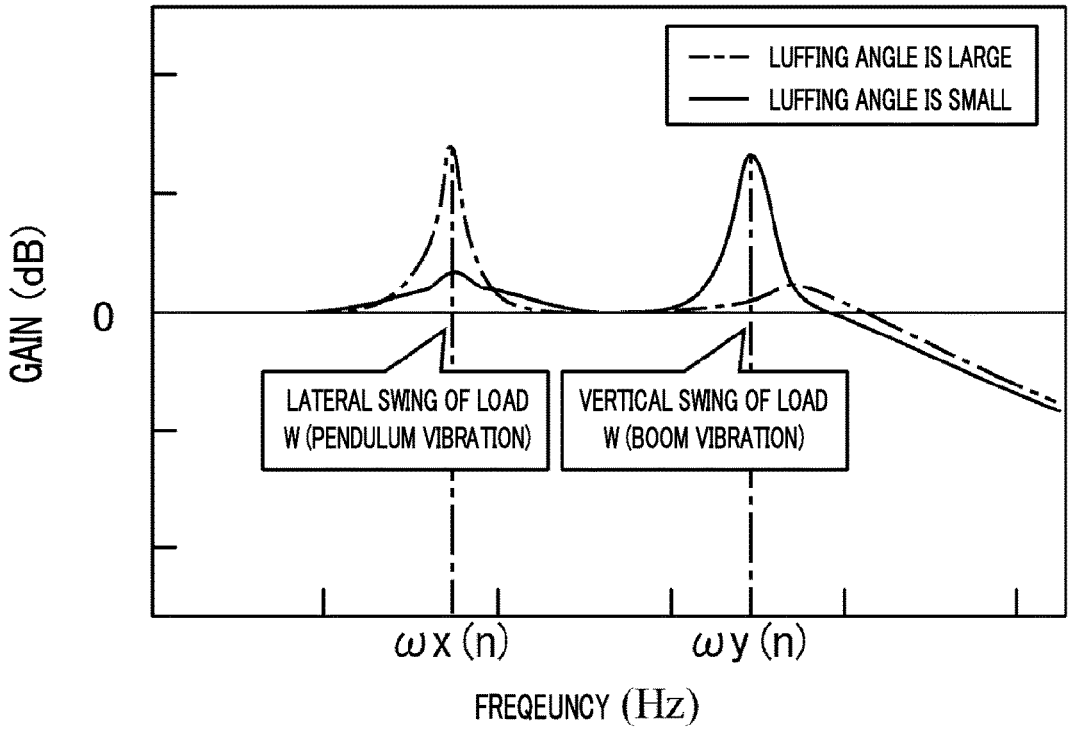
Figure 6B:
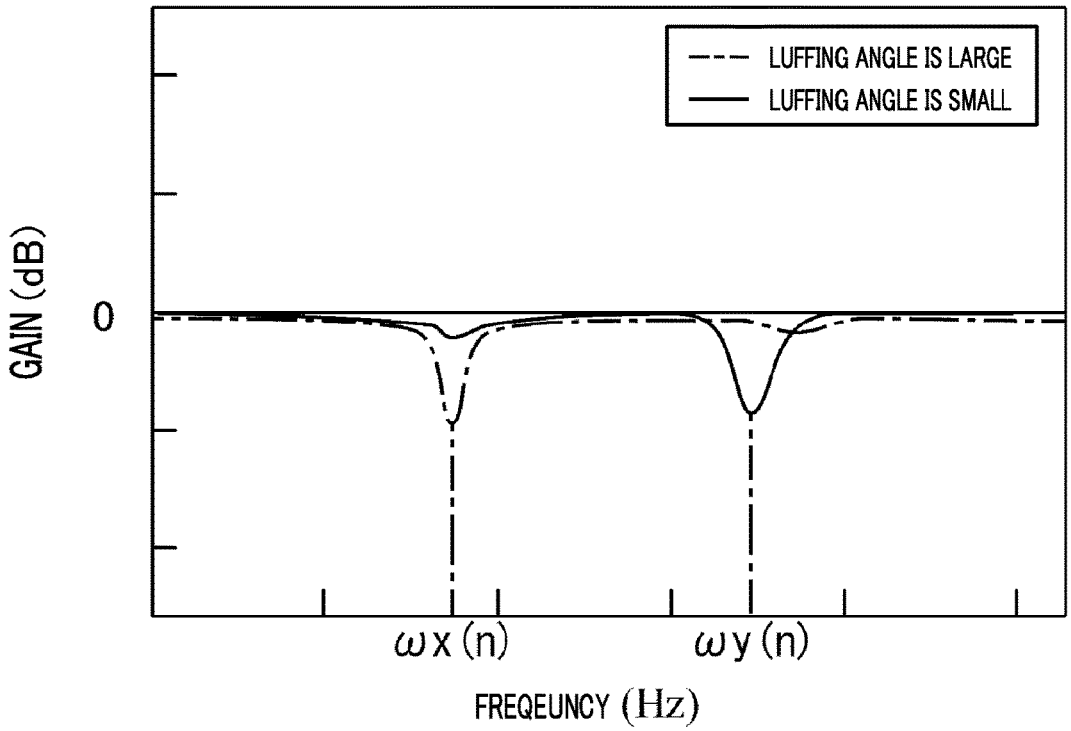
Figure 7A:
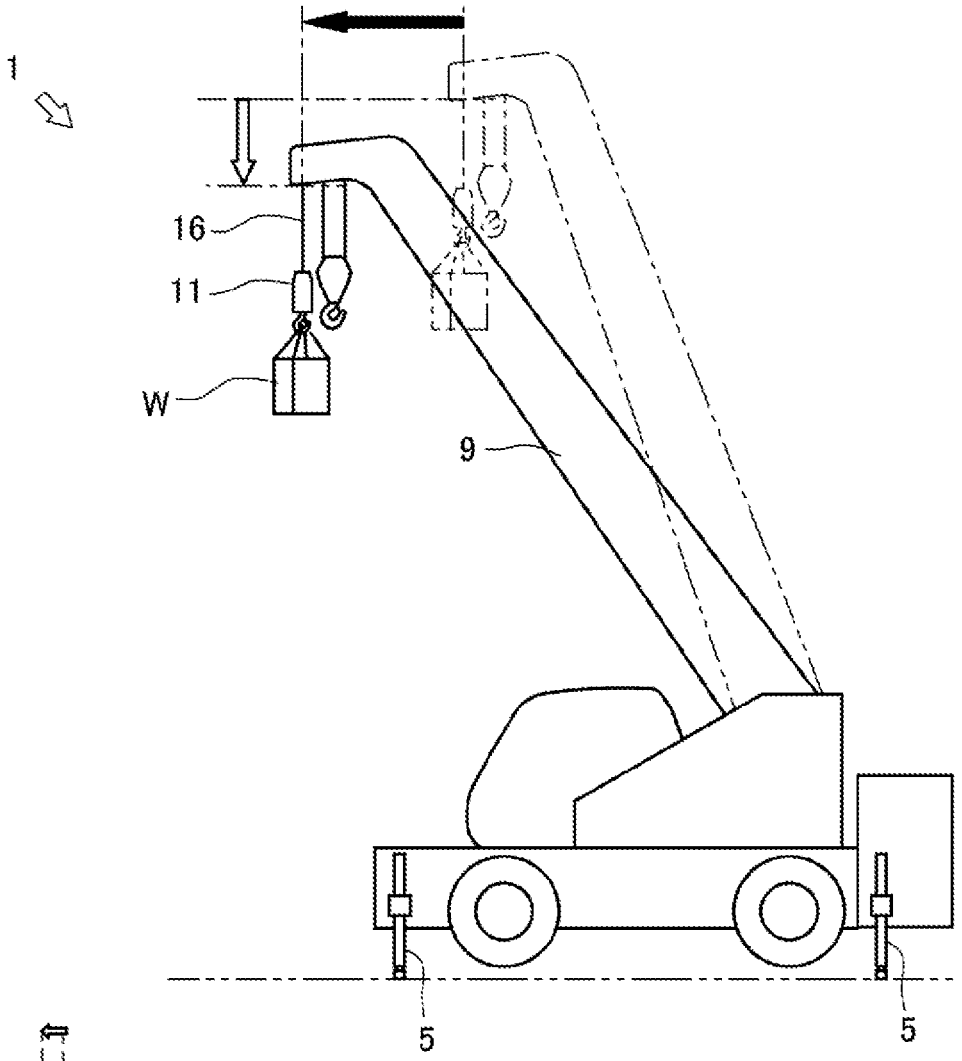

As illustrated in FIGS. 6A, 6B, and 7A, in telescopic boom 9, a moving amount in the lateral direction (the longitudinal direction of telescopic boom 9 as projected vertically downward) (see the black solid arrow) per unit time at the start of the luffing operation becomes increasingly greater than an moving amount in the vertical direction (vertically upper-lower direction that is the direction in which gravity acts) (see the white solid arrow) as the luffing angle before the luffing operation increases (as the attitude before the luffing operation is more in the luffed-up state). In other words, in crane 1, the larger the luffing angle of telescopic boom 9 before the luffing operation is, the greater the acceleration of load W in the lateral direction (the force for swinging load W at resonance frequency ωx(n)) is, and the smaller the acceleration of telescopic boom 9 in the luffing direction (the force for swinging telescopic boom 9 at natural frequency ωy(n) in the luffing direction) is.

Figure 7B:
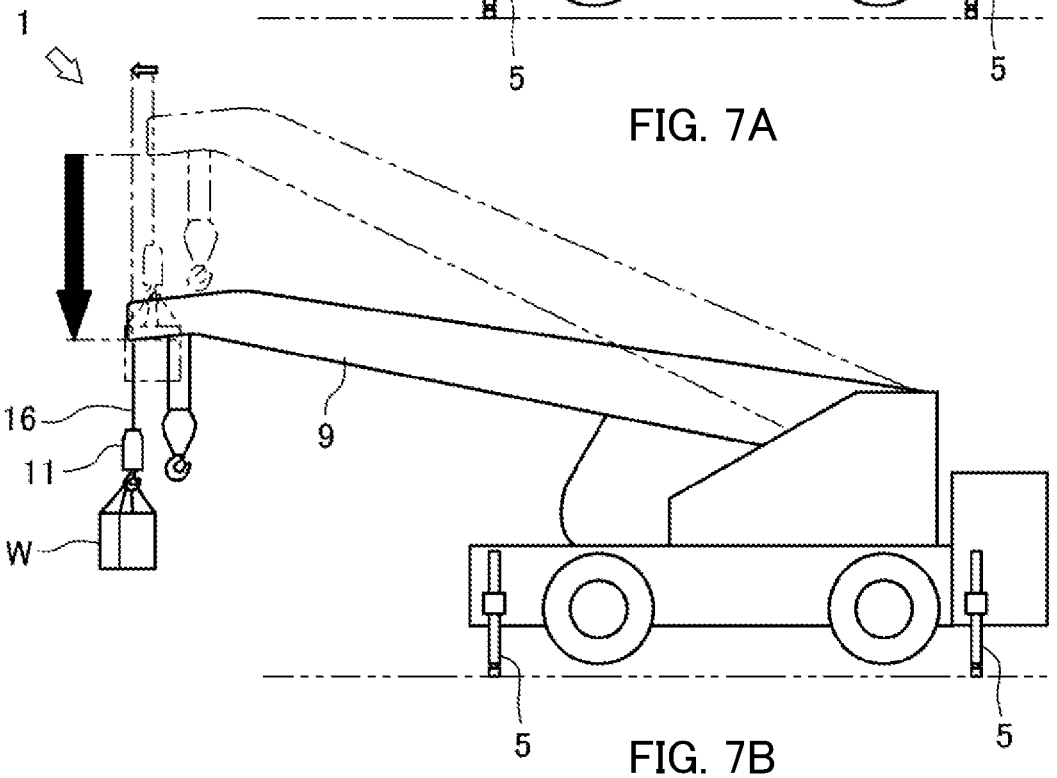

Likewise, as illustrated in FIGS. 6A, 6B and 7B, in telescopic boom 9, the moving amount in the vertical direction (see the black solid arrow) per unit time at the start of the luffing operation becomes increasingly greater than the moving amount in the lateral direction (horizontal direction) (see the white solid arrow) as the luffing angle before the luffing operation decreases (as the attitude before the luffing operation is more in the luffed-down state). In other words, in crane 1, the smaller the luffing angle of telescopic boom 9 before the luffing operation is, the greater the acceleration of load W in the luffing direction (the force for swinging telescopic boom 9 at natural frequency ωy(n)) is, and the smaller the acceleration of load W in the lateral direction (the force for swinging load W at resonance frequency ωx(n)) is.

When the lateral acceleration of load W is constant, the smaller resonance frequency ωx(n) is, the greater the lateral swing amount of load W is. In addition, when the acceleration of telescopic boom 9 in the luffing direction is constant, the smaller natural frequency ωy(n) of telescopic boom 9 in the luffing direction is, the greater the vertical swing amount of load W, which is the vertical swing amount of telescopic boom 9, is. Thus, the lateral swing amount of load W is proportional to a coefficient of the swing in the horizontal direction that is a value obtained by dividing luffed-up angle θa based on the state in which the luffing angle of telescopic boom 9 is 0° (horizontal state) by resonance frequency ωx(n) (hereinafter, simply referred to as "lateral swing coefficient Kx"). On the other hand, the vertical swing amount of load W is proportional to a coefficient of the swing in the luffing direction that is a value obtained by dividing luffed-down angle θb (the angle at which the telescopic boom is luffed down from the luffing angle of 90°) based on the state (vertical state) in which luffing angle θ of telescopic boom 9 is 90° by natural frequency ωy(n) (hereinafter, simply referred to as "vertical swing coefficient Ky").

Control device 33 computes, at filter-coefficient computation section 33*d*, lateral swing coefficient Kx and vertical swing coefficient Ky based on the obtained luffing angle, resonance frequency ωx(n) of load W, and natural frequency ωy(n) of telescopic boom 9 in the luffing direction. Further, control device 33 determines the ratio between notch depth coefficient δx of notch filter Fx(n) for reducing the lateral swing at resonance frequency ωx(n) of load W and notch depth coefficient δy of notch filter Fy(n) for reducing the vertical swing at natural frequency ωy(n) of telescopic boom 9 in the luffing direction based on the computed ratio between lateral swing coefficient Kx and vertical swing coefficient Ky. Then, filter-coefficient computation section 33*d* computes notch depth coefficient δx and notch depth coefficient δy according to the determined depth coefficient ratio.

When lateral swing coefficient Kx is greater than vertical swing coefficient Ky, that is, when the lateral swing at resonance frequency ωx(n) of load W is computed to be greater than the vertical swing at natural frequency ωy(n) of telescopic boom 9 in the luffing direction, control device 33 sets, based on the ratio between lateral swing coefficient Kx and vertical swing coefficient Ky, notch depth coefficient δx such that notch depth Dn of notch filter Fx(n) for reducing the swing at resonance frequency ωx(n) of load W is deep (such that the attenuation ratio is great). Meanwhile, control device 33 sets, at filter-coefficient computation section 33*d*, notch depth coefficient δy such that notch depth Dn of notch filter Fy(n) for reducing the swing at natural frequency ωy(n) of telescopic boom 9 in the luffing direction is shallow (such that the attenuation ratio is small).

Likewise, when lateral swing coefficient Kx is smaller than vertical swing coefficient Ky, that is, when the lateral swing at resonance frequency ωx(n) of load W is computed to be smaller than the vertical swing at natural frequency ωy(n) of telescopic boom 9 in the luffing direction, control device 33 sets notch depth coefficient δx such that notch depth Dn of notch filter Fx(n) for reducing the swing at resonance frequency ωx(n) of load W is shallow (such that the attenuation ratio is small). Meanwhile, control device 33 sets notch depth coefficient δy such that notch depth Dn of notch filter Fy(n) for reducing the lateral swing at natural frequency ωy(n) of telescopic boom 9 in the luffing direction is deep (such that the attenuation ratio is great).

At this time, control device 33 determines, irrespective of the ratio between notch depth coefficient δx of notch filter Fx(n) for reducing the lateral swing at resonance frequency ωx(n) of load W and notch depth coefficient δy of notch filter Fy(n) for reducing the vertical swing at natural frequency ωy(n) of telescopic boom 9 in the luffing direction, notch depth coefficient δx and notch depth coefficient δy such that the inertially-driven amount of telescopic boom 9 to be operated according to filtered control signal Cd (n) to which notch filter Fx(n) and notch filter Fy(n) are applied is constant. That is, control device 33 determines notch depth coefficient δx and notch depth coefficient δy such that the inertially-driven amount at the time when telescopic boom 9 is stopped remains constant even when the extension/retraction amount and the luffing angle of telescopic boom 9 and/or the length of sub wire rope 16 are changed.

In crane 1 configured as described above, control device 33 sets notch filter Fx(n) and notch filter Fy(n) based on the ratio between lateral swing coefficient Kx and vertical swing coefficient Ky computed based on the state of telescopic boom 9 and the length of sub wire rope 16, to apply the notch filters to control signal C(n). It is thus possible for crane 1 to attenuate a frequency component in any frequency range with reference to resonance frequency ωx(n) of load W while attenuating a frequency component in any frequency range with reference to natural frequency ωy(n) of telescopic boom 9 in the luffing direction, so as to efficiently reduce the lateral swing at resonance frequency ωx(n) of load W and the vertical swing at natural frequency ωy(n) of telescopic boom 9 in the luffing direction that are caused during the luffing operation.

Figure 8A:
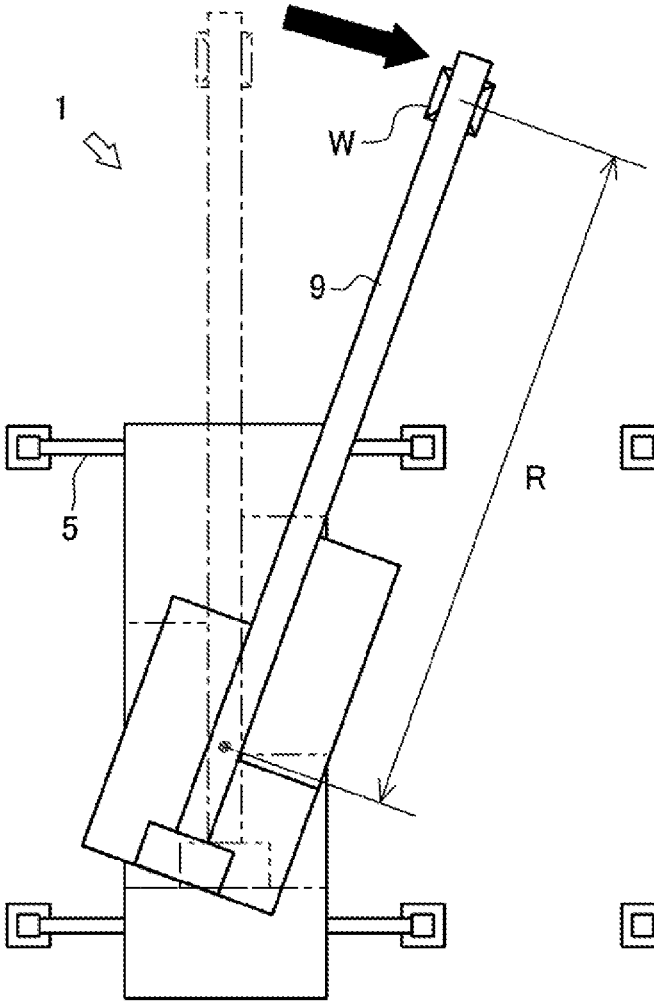
Figure 8B:
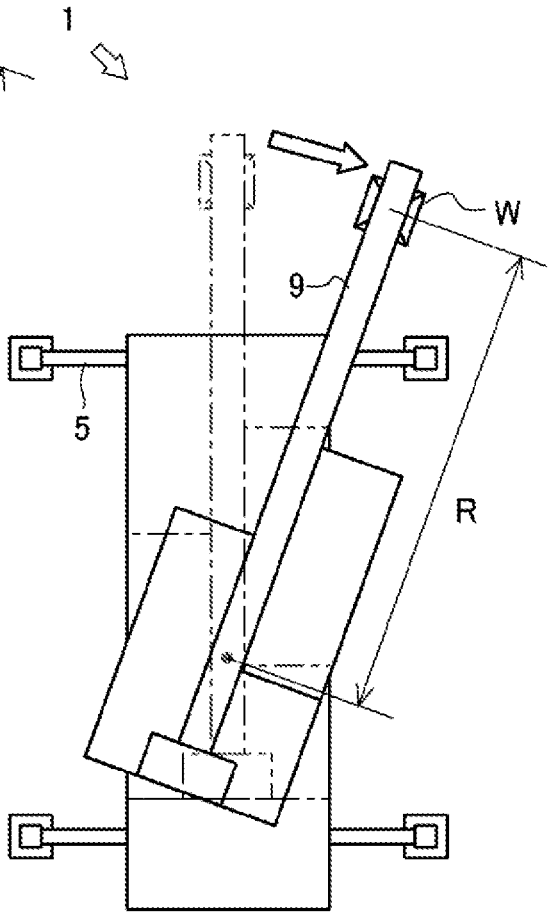

Next, with reference to FIGS. 8A and 8B, a description will be given of setting depth coefficient δx of notch filter Fx(n) for reducing the swing at resonance frequency ωx(n) of load W and notch depth coefficient δz of notch filter Fz(n) for reducing the swing at natural frequency ωz(n) of telescopic boom 9 in the swiveling direction, which are applied to control signal C(n) during the swivel operation of crane 1. Here, the description is given on the assumption that load W is suspended using sub wire rope 16. FIG. 8A illustrates a state in which the luffing angle of telescopic boom 9 is small (the attitude is in the luffed-down state), and FIG. 8B illustrates a state in which the luffing angle of telescopic boom 9 is large (the attitude is in the luffed-up state). Note that, the boom length of telescopic boom 9 is constant during the swivel operation.

Control device 33 computes, at filter-coefficient computation section 33*d*, resonance frequency ωx (n) determined based on suspension length Ls(n) of sub wire rope 16, and natural frequency ωz (n) of telescopic boom 9 in the swiveling direction during the swivel operation of telescopic boom 9. Control device 33 computes, at filter-coefficient computation section 33*d*, notch depth coefficient δx of notch filter Fx(n) whose center frequency ωc is resonance frequency ωx(n) and notch depth coefficient δz of notch filter Fz(n) whose center frequency ωc is natural frequency ωz(n) according to the luffing angle detected by luffing encoder 30 (see FIG. 2). In addition, control device 33 sets, at filter-coefficient computation section 33*d*, notch width coefficient ζx and notch width coefficient ζz to predetermined fixed values. Note that, notch width coefficient ζx and notch width coefficient ζz are set to the predetermined fixed values, but may also be set based on the operational state of crane 1.

As illustrated in FIG. 8A, in telescopic boom 9, the smaller the luffing angle is (the more telescopic boom 9 is in the luffed-down state), the greater swivel radius R of telescopic boom 9, which is the horizontal distance from the swivel center to the leading end of telescopic boom 9, is. Accordingly, in telescopic boom 9, the smaller the luffing angle at the time of the swivel operation is, the greater the moving amount of the leading end per unit time at the start of the swivel operation (see the black solid arrow) is. In other words, in crane 1, the smaller the luffing angle of telescopic boom 9 is, the greater the acceleration of load W in the swiveling direction (the force for swinging load W at resonance frequency ωx(n)) is.

As illustrated in FIG. 8B, the larger the luffing angle is (the more telescopic boom 9 is in the luffed-up state), the smaller swivel radius R of telescopic boom 9 is. Accordingly, in telescopic boom 9, the larger the luffing angle at the time of the swivel operation is, the smaller the moving amount of the leading end per unit time at the start of the swivel operation (see the white solid arrow) is. In other words, in crane 1, the larger the luffing angle of telescopic boom 9 is, the smaller the acceleration of load W in the swiveling direction (the force for swinging load W at resonance frequency ωx(n)) is.

When the acceleration of telescopic boom 9 in the swiveling direction is constant, the smaller natural frequency ωz(n) of telescopic boom 9 in the swiveling direction is, the greater the swing amount of load W in the swiveling direction, which is the swing amount of telescopic boom 9 in the swiveling direction, is. Thus, the swing amount of load W in the swiveling direction is proportional to a coefficient of the swing in the swiveling direction that is a value obtained by dividing luffed-up angle θa that is based on the state in which the luffing angle of telescopic boom 9 is 0° (horizontal state) by natural frequency ωc(n) (hereinafter, simply referred to as "swiveling swing coefficient Kz").

Control device 33 computes, at filter-coefficient computation section 33*d*, lateral swing coefficient Kx and swiveling swing coefficient Kz based on the obtained luffing angle, resonance frequency ωx(n) of load W, and natural frequency ωz(n) of telescopic boom 9 in the swiveling direction. Further, control device 33 determines the ratio between notch depth coefficient δx of notch filter Fx(n) for reducing the lateral swing at resonance frequency ωx(n) of load W and notch depth coefficient δz of notch filter Fz(n) for reducing the swiveling swing at natural frequency ωz(n) of telescopic boom 9 in the swiveling direction based on the computed ratio between lateral swing coefficient Kx and swiveling swing coefficient Kz. Then, filter-coefficient computation section 33*d* computes notch depth coefficient δx and notch depth coefficient δz according to the determined depth coefficient ratio.

Control device 33 sets notch depth coefficient δx of notch filter Fx(n) for reducing the swing at resonance frequency ωx(n) of load W and notch depth coefficient δz of notch filter Fz(n) for reducing the swiveling swing at natural frequency ωz(n) of telescopic boom 9 in the swiveling direction based on the ratio between lateral swing coefficient Kx and swiveling swing coefficient Kz.

In crane 1 configured as described above, control device 33 sets notch filter Fx(n) and notch filter Fz(n) based on the ratio between lateral swing coefficient Kx and swiveling swing coefficient Kz computed based on the state of telescopic boom 9 and the length of sub wire rope 16, to apply the notch filters to control signal C(n). It is thus possible for crane 1 to attenuate a frequency component in any frequency range with reference to resonance frequency ωx(n) of load W while attenuating a frequency component in any frequency range with reference to natural frequency ωz(n) of telescopic boom 9 in the swiveling direction, so as to efficiently reduce the lateral swing at resonance frequency ωx(n) of load W and the swiveling swing at natural frequency ωz(n) of telescopic boom 9 in the swiveling direction that are caused during the swivel operation.

A description will be given of a vibration control of control device 33 based on the operational state of crane 1 with reference to FIGS. 9 to 11. The description will be given on the supposition that at least one of control signal C(n) according to the manipulation of a single manipulation tool, control signal C(n+1) according to the manipulation of another manipulation tool, and control signal C(ne) at the time of the emergency manipulation by the emergency stop manipulation of a manipulation tool according to the manipulation state of a manipulation tool is generated in crane 1. When crane 1 is operated manually by manipulation of any of swivel manipulation tool 18, luffing manipulation tool 19, extension and retraction manipulation tool 20, main-drum manipulation tool 21, and sub-drum manipulation tool 22 (hereinafter, such a manipulation tool is simply referred to as "manipulation tool") in the vibration control, control device 33 obtains control signal C(n) generated based on a single manipulation tool from control-signal generation section 33*a* and then sets notch filter Fx(n) and at least one of notch filter Fy(n) and notch filter Fz(n) corresponding to control signal C(n).

Control device 33 sets notch depth coefficient δx of notch filter Fx(n). For example, in the case of a manual control in which the manipulability of the manipulation tool is to be prioritized, control device 33 applies to control signal C(n) notch filter Fx(n1) for reducing the swing at resonance frequency ωx(n) of load W, for which notch depth coefficient δx (for example, δx=0.7) is set. Thus, crane 1 prioritizes keeping the manipulability of the manipulation tool over reducing the vibration of load W at resonance frequency ωx(n).

In contrast, in the case of an automatic control in which the vibration reducing effect is to be prioritized, control device 33 applies to control signal C(n) notch filter Fx(n2) for reducing the swing at resonance frequency ωx(n) of load W, for which notch depth coefficient δx (for example, δx=0.5) is set. Crane 1 can thus enhance the effect of reducing the vibration of load W at resonance frequency ωx(n).

Likewise, control device 33 sets notch depth coefficient δy of notch filter Fy(n). For example, in the case of the manual control in which the manipulability of the manipulation tool is to be prioritized, control device 33 applies to control signal C(n) notch filter Fy(n3) for reducing the swing at natural frequency ωy(n) of telescopic boom 9 in the luffing direction, for which notch depth coefficient δy (for example, δy=0.7) is set. Thus, crane 1 prioritizes keeping the manipulability of the manipulation tool over reducing the vibration at natural frequency ωy(n) of telescopic boom 9 in the luffing direction.

In contrast, in the case of the automatic control in which the vibration reducing effect is to be prioritized, control device 33 applies to control signal C(n) notch filter Fy(n4) for reducing the swing at natural frequency ωy(n) of telescopic boom 9 in the luffing direction, for which notch depth coefficient δy (for example, δy=0.5) is set. Crane 1 can thus enhance the effect of reducing the vibration at natural frequency ωy(n) of telescopic boom 9 in the luffing direction. Note that, a description of setting notch depth coefficient δz of notch filter Fz(n) for reducing the swing at natural frequency ωz(n) of telescopic boom 9 in the swiveling direction by control device 33 is omitted since setting notch depth coefficient δz of notch filter Fz(n) is the same as setting notch depth coefficient δy of notch filter Fy(n).

When control device 33 obtains control signal C(n) generated based on a single manipulation tool from control-signal generation section 33*a*, control device 33 applies to control signal C(n) notch filter Fx(n1) for reducing the swing at resonance frequency ωx(n) of load W, and notch filter Fy(n3) for reducing the swing at natural frequency ωy(n) of telescopic boom 9 in the luffing direction or notch filter Fz(n3) for reducing the swing at natural frequency ωz(n) of telescopic boom 9 in the swiveling direction in order to prioritize the manipulability of the manipulation tool.

When control device 33 obtains only control signal C(n) generated by the manipulation of luffing manipulation tool 19, control device 33 applies, to control signal C(n), notch filter Fx(n1) for which notch depth coefficient δx being a value close to one is set on the basis of the ratio between lateral swing coefficient Kx and vertical swing coefficient Ky computed from the luffing angle, resonance frequency ωx(n), and natural frequency ωy(n), and notch filter Fy(n3) for which notch depth coefficient δy being a value close to one is set on the basis of the ratio between lateral swing coefficient Kx and vertical swing coefficient Ky, so as to generate filtered control signal Cd(n) in order to prioritize the manipulability of luffing manipulation tool 19.

When control device 33 obtains only control signal C(n) generated by the manipulation of swivel manipulation tool 18, control device 33 applies, to control signal C(n), notch filter Fx(n1) for which notch depth coefficient δx being a value close to one is set on the basis of the ratio between lateral swing coefficient Kx and swiveling swing coefficient Kz computed from the luffing angle, resonance frequency ωx(n), and natural frequency ωz(n), and notch filter Fz(n3) for which notch depth coefficient δz being a value close to one is set on the basis of the ratio between lateral swing coefficient Kx and swiveling swing coefficient Kz, so as to generate filtered control signal Cd(n) in order to prioritize the manipulability of swivel manipulation tool 18.

In the case of a manual control in which a single manipulation tool (e.g., luffing manipulation tool 19) alone is being manipulated and another manipulation tool (e.g., swivel manipulation tool 18) is further manipulated, and, when control device 33 obtains control signal C(n) generated based on the manipulation of luffing manipulation tool 19 and then control signal C(n+1) generated based on the manipulation of swivel manipulation tool 18 from control-signal generation section 33*a*, control device 33 switches from notch filter Fx(n1) and notch filter Fy(n3) to notch filter Fx(n2) and notch filter Fy(n4), and applies the notch filters to control signal C(n) to generate filtered control signal Cd(n) and applies notch filter Fx(n2) and notch filter Fz(n4) to control signal C(n+1) to generate filtered control signal Cd(n+1) in order to prioritize the vibration reducing effect.

For example, in manipulation with a remote manipulation device or the like, it is possible that, when the manipulation amount of a single manipulation tool is applied as the manipulation amount of another manipulation tool, a variation amount per unit time (acceleration) of control signal C(n+1) of the other manipulation tool may become significantly greater. Specifically, in a case where an ON/OFF switch of the swivel manipulation, an ON/OFF switch of the luffing manipulation, and a common speed lever for setting the speed of both of the manipulations are provided, and when the ON/OFF switch of the swivel manipulation is turned on and the luffing switch is turned on during the swivel operation at any speed, the speed setting for the swivel operation is applied for the luffing manipulation. That is, it is possible that a large vibration may arise when manipulation is started with a plurality of manipulation tools. For this reason, when a single manipulation tool is manipulated alone and, during this manipulation, another manipulation tool is further operated, notch filter F(n) is switched for prioritization of the vibration reducing effect.

Accordingly, in manipulation of a single manipulation tool alone, crane 1 can apply to control signal C(n) notch filter Fx(n1) for reducing the swing at resonance frequency ωx(n) of load W and notch filter Fy(n3) for reducing the swing at natural frequency ωy(n) of telescopic boom 9 in the luffing direction or notch filter Fz(n3) for reducing the swing at natural frequency ωz(n) of telescopic boom 9 in the swiveling direction, so as to generate filtered control signal Cd(n) for reducing the vibration that is caused in load W and is related to resonance frequency ωx(n) of the pendulum and the vibration that is caused in load W and is related to the natural frequency of the telescopic boom to such an extent that it is possible to prioritize keeping the manipulability. Moreover, in manipulation to use a plurality of manipulation tools in combination by which a vibration is easily caused, crane 1 can also apply notch filter Fx(n2) and notch filter Fy(n4) or notch filter Fz(n4), so as to generate filtered control signal Cd(n) and filtered control signal Cd(n+1) for preferentially reducing the vibration that is caused in load W and is related to resonance frequency ωx(n) of the pendulum and the vibration that is caused in load W and is related to the natural frequency of telescopic boom 9, respectively.

In addition, in a case where crane 1 is operated under the automatic control, such as automatic stop performed before crane 1 reaches an operation restriction area, automatic carriage, or the like, and when filter-coefficient computation section 33*d* obtains control signal C(na) which is not based on manipulation of any of the manipulation tools from control-signal generation section 33*a*, control device 33 applies to control signal C(na) notch filter Fx(n2) for which notch depth coefficient δx of a value close to 0 is set and notch filter Fy(n4) for which notch depth coefficient δy of a value close to 0 is set or notch filter Fz(n4) for which notch depth coefficient δz of a value close to 0 is set, so as to generate control signal Cd(na).

For example, in a case where any limitation and/or any stop position are set due to restrictions of a working region and load W enters such a working region, crane 1 operates based on control signal C(na) of the automatic control without manipulation of any of the manipulation tools. Also in a case where an automatic carriage mode is set for crane 1, crane 1 operates based on control signal C(na) of the automatic control for carrying predetermined load W along a predetermined carrying path at a predetermined carrying speed at a predetermined carrying height for predetermined load W. That is, since crane 1 is manipulated not by an operator but under the automatic control, it is unnecessary to prioritize the manipulability of the manipulation tool. Accordingly, control device 33 applies notch filter Fx(n2) with notch depth coefficient δx of a value close to 0 and notch filter Fy(n4) with notch depth coefficient δy of a value close to 0 to control signal C(na) so as to generate filtered control signal Cd(na) in order to prioritize the vibration reducing effect. It is thus possible for crane 1 to enhance the effect of reducing the vibration of load W at resonance frequency ωx(n) and the effect of reducing the vibration at natural frequency ωy(n) of telescopic boom 9 in the luffing direction. That is, crane 1 can generate filtered control signal Cd(na) for prioritizing the vibration reducing effect in the automatic control.

In addition, when the emergency stop manipulation by manually manipulating a specific manipulation tool or the emergency stop manipulation with a manipulation tool in a specific manipulation procedure is carried out, control device 33 does not apply notch filter Fx(n), notch filter Fy(n), and notch filter Fz(n) to control signal C(ne) generated based on the emergency stop manipulation of any of the manipulation tools.

For example, when the emergency stop manipulation for bringing all the manipulation tools back to neutral states at once is performed in order to immediately stop swivel base 7 and telescopic boom 9 of crane 1, control device 33 determines that specific manual manipulation is performed and does not apply notch filter Fx(n), notch filter Fy(n), and notch filter Fz(n) to control signal C(ne) generated based on the emergency stop manipulation of the manipulation tools. Accordingly, keeping the manipulability of the manipulation tools is prioritized in crane 1 and swivel base 7 and telescopic boom 9 are immediately stopped without any delay. That is, crane 1 does not carry out the vibration control in the emergency stop manipulation of the manipulation tools.

Hereinafter, the vibration control of control device 33 based on the operational state of crane 1 on the lateral swing at resonance frequency ωx(n) of load W, the vertical swing at natural frequency ωy (n) of telescopic boom 9 in the luffing direction, and the swiveling swing at natural frequency ωz(n) of telescopic boom 9 in the swiveling direction will be specifically described with reference to FIGS. 9 to 11. The description is given on the assumption that control device 33 generates, at control-signal generation section 33*a* at each scan time, control signal C(n) that is a speed command for any of swivel manipulation tool 18, luffing manipulation tool 19, extension/retraction manipulation tool 20, main-drum manipulation tool 21, and sub-drum manipulation tool 22 based on the manipulation amount of the manipulation tool. The description is given also on the assumption that control device 33 obtains the luffing angle of telescopic boom 9 to compute resonance frequency ωx(n) of load W for suspension length Ls(n) of sub wire rope 16, natural frequency ωy(n) of telescopic boom 9 in the luffing direction, and natural frequency ωz(n) of telescopic boom 9 in the swiveling direction.

Figure 9:
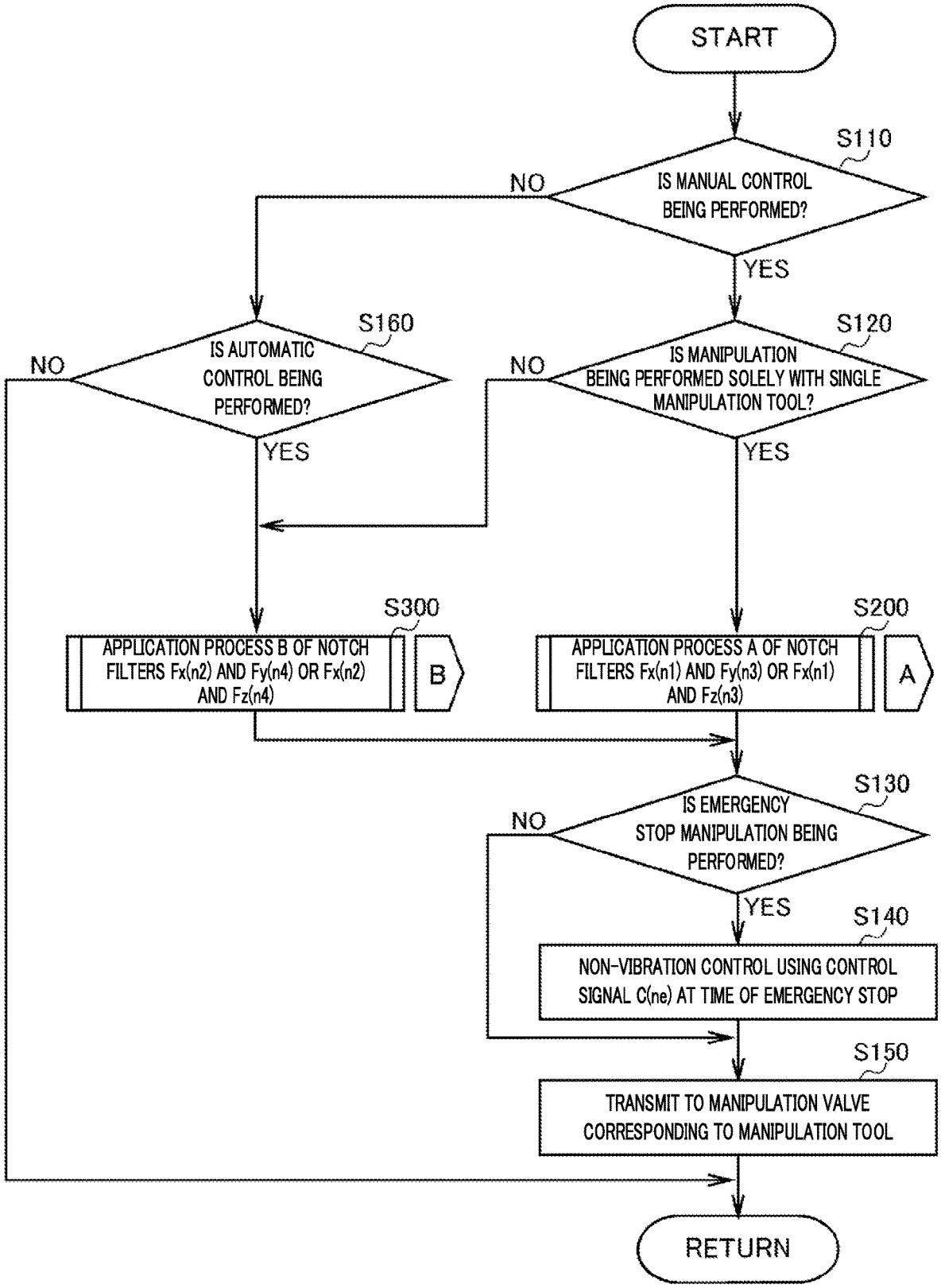
FIG. 9 is a diagram illustrating a flowchart indicating an overall control mode of vibration control.

As illustrated in FIG. 9, control device 33 determines at step S110 of the vibration control whether or not the manual control in which a manipulation tool is manipulated is being carried out.

When a result of the determination indicates that the manual control in which the manipulation tool is manipulated is being carried out, control device 33 proceeds to step S120.

On the other hand, when the manual control in which the manipulation tool is manipulated is not being carried out, control device 33 proceeds to step S160.

At step S120, control device 33 determines whether or not a single manipulation tool is being manipulated.

When a result of the determination indicates that the single manipulation tool is being manipulated (that is, when a single actuator is being controlled by manipulation of the single manipulation tool), control device 33 proceeds to step S200.

On the other hand, when the manipulation is not only by the single manipulation tool (that is, when a plurality of actuators are being controlled by manipulation of a plurality of manipulation tools), control device 33 proceeds to step S300.

Figure 10:
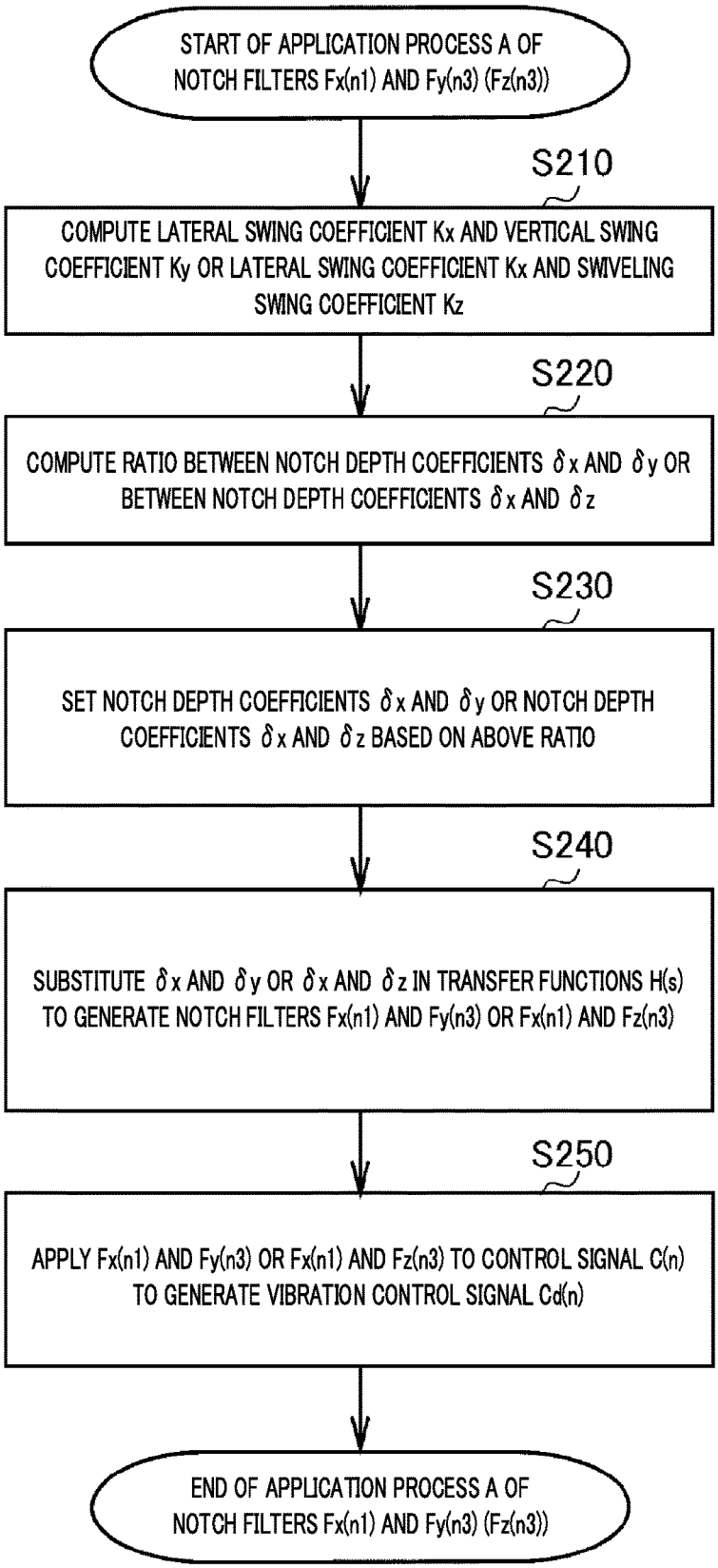
FIG. 10 illustrates a flowchart indicating a process of applying the notch filter in manipulation of a single manipulation tool alone in the vibration control.

Control device 33 starts application process A of applying notch filter Fx(n1) and notch filter Fy(n3) or notch filter Fz(n3) at step S200, and proceeds to step S210 (see FIG. 10). Then, after application process A of applying notch filter Fx(n1) and notch filter Fy(n3) or notch filter Fz(n3) is ended, control device 33 proceeds to step S130 (see FIG. 9).

As illustrated in FIG. 9, control device 33 determines at step S130 whether or not the emergency stop manipulation with a manipulation tool in a specific manipulation procedure is being performed.

When a result of the determination indicates that the emergency stop manipulation with the manipulation tool in the specific manipulation procedure is being performed (that is, when control signal C(ne) at the time of the emergency stop manipulation is generated), control device 33 proceeds to step S140.

On the other hand, when the emergency stop manipulation with the manipulation tool in the specific manipulation procedure is not being performed (that is, when control signal C(ne) at the time of the emergency stop manipulation is not generated), control device 33 proceeds to step S150.

Control device 33 generates control signal C(ne) at the time of the emergency manipulation according to the emergency stop manipulation at step S140. That is, control device 33 generates control signal C(ne) to which none of notch filter Fx(n1), notch filter Fy(n3), and notch filter Fz(n3) is applied, and proceeds to step S150.

Control device 33 transmits the generated filtered control signal to a manipulation valve corresponding to the generated filtered control signal at step S150, and proceeds to step S110. Alternatively, when control signal C(ne) at the time of the emergency stop manipulation is generated, control device 33 transmits only control signal C(ne) at the time of the emergency stop manipulation to the corresponding manipulation valve, and proceeds to step S110.

Control device 33 determines at step S160 whether or not the automatic control is being carried out.

When a result of the determination indicates that the automatic control is being carried out, control device 33 proceeds to step S300.

On the other hand, when the automatic control is not being carried out (that is, when none of control signal C(n) of the manual control and control signal C(na) of the automatic control are generated), control device 33 proceeds to step S110.

Figure 11:
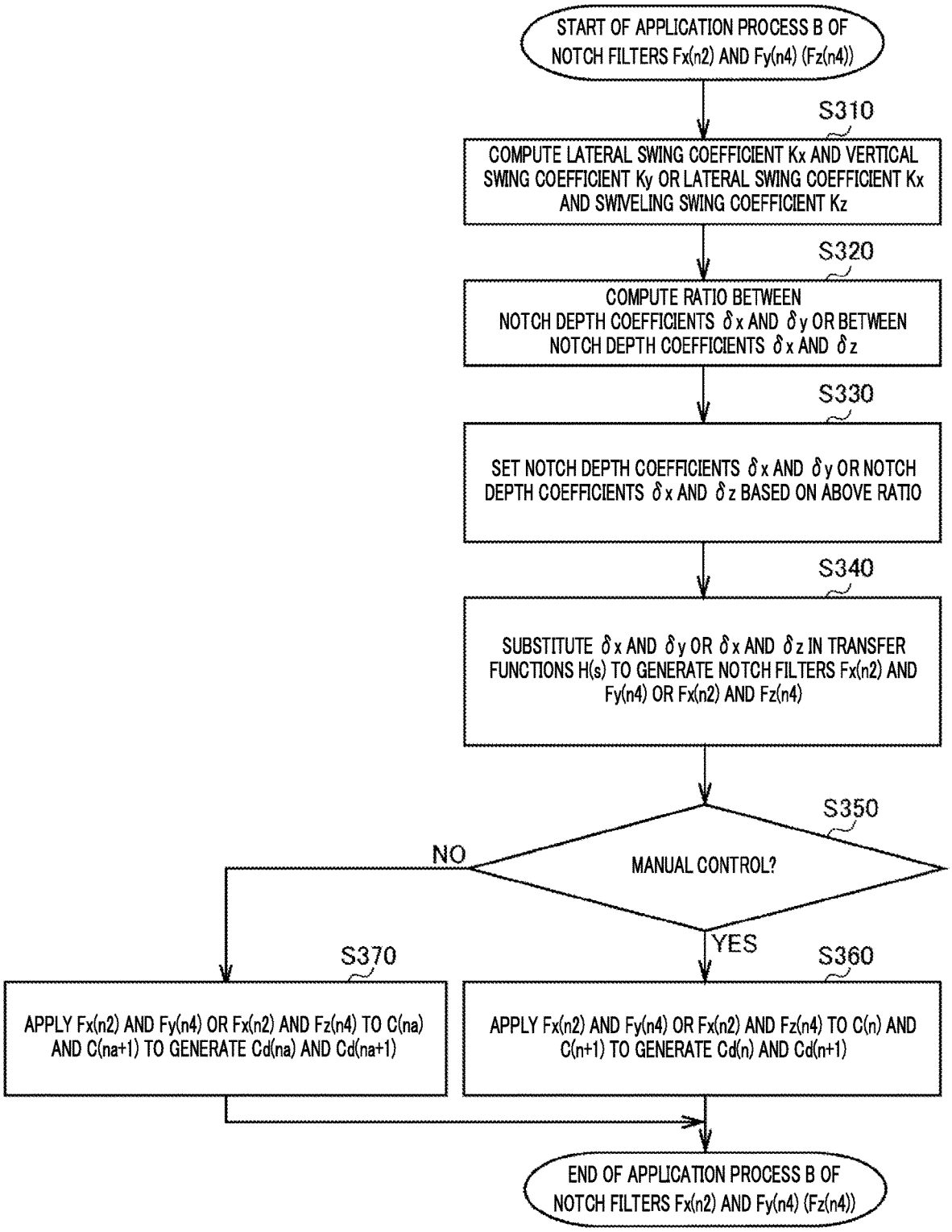
FIG. 11 illustrates a flowchart indicating a process of applying the notch filter in manipulation of a plurality of manipulation tools in the vibration control.

Control device 33 starts application process B of applying notch filter Fx(n2) and notch filter Fy(n4) or notch filter Fz(n4) at step S300, and proceeds to step S310 (see FIG. 11). Then, after application process B of applying notch filter Fx(n2) and notch filter Fy(n4) or notch filter Fz(n4) is ended, control device 33 proceeds to step S130 (see FIG. 9).

As illustrated in FIG. 10, control device 33 computes lateral swing coefficient Kx and vertical swing coefficient Ky or swiveling swing coefficient Kz based on the luffing angle of telescopic boom 9, resonance frequency ωx(n) of load W, and natural frequency ωy(n) of telescopic boom 9 in the luffing direction or natural frequency ωz(n) of telescopic boom 9 in the swiveling direction at step S210 of application process A of applying notch filter Fx(n1) and notch filter Fy(n3) or notch filter Fz(n3), and then proceeds to step S220.

Control device 33 computes the ratio between notch depth coefficient δx of notch filter Fx(n) whose center frequency we is resonance frequency ωx(n) and notch depth coefficient δy of notch filter Fy(n) whose center frequency we is natural frequency ωy(n) of telescopic boom 9 in the luffing direction or notch depth coefficient δz of notch filter Fz(n) whose center frequency we is natural frequency ωz(n) of telescopic boom 9 in the swiveling direction based on the computed ratio between lateral swing coefficient Kx to vertical swing coefficient Ky or swiveling swing coefficient Kz at step S220, and then proceeds to step S230.

Control device 33 sets notch depth coefficient δx and notch depth coefficient δy or notch depth coefficient δz to a value close to 1 based on the computed ratio between notch depth coefficient δx and notch depth coefficient δy or notch depth coefficient δz in order to prioritize the manipulability of the manipulation tool at step S230, and then proceeds to step S240.

Control device 33 applies set notch depth coefficient δx to transfer function H(s) of notch filter Fx(n) to generate notch filter Fx(n1), and applies set notch depth coefficient δy or notch depth coefficient δz to corresponding transfer function H(s) of notch filter Fy(n) or notch filter Fz(n) to generate notch filter Fy(n3) or notch filter Fz(n3) at step S240, and then proceeds to step S250.

Control device 33 applies notch filter Fx(n1) and notch filter Fy(n3) or notch filter Fz(n3) to control signal C(n) to generate filtered control signal Cd(n) corresponding to control signal C(n) at step S250, ends application process A of applying notch filter Fx(n1) and notch filter Fy(n3) or notch filter Fz(n3), and proceeds to step S130.

As illustrated in FIG. 11, control device 33 computes lateral swing coefficient Kx and vertical swing coefficient Ky or swiveling swing coefficient Kz based on the luffing angle of telescopic boom 9, resonance frequency ωx(n) of load W, and natural frequency ωy(n) of telescopic boom 9 in the luffing direction or natural frequency ωz(n) of telescopic boom 9 in the swiveling direction at step S310 of application process B of applying notch filter Fx(n2) and notch filter Fy(n4) or notch filter Fz(n4), and then proceeds to step S320.

Control device 33 computes the ratio between notch depth coefficient δx of notch filter Fx(n) whose center frequency ωc is resonance frequency ωx(n) and notch depth coefficient δy of notch filter Fy(n) whose center frequency ωc is natural frequency ωy(n) of telescopic boom 9 in the luffing direction or notch depth coefficient δz of notch filter Fz(n) whose center frequency ωc is natural frequency ωz(n) of telescopic boom 9 based on the computed ratio between lateral swing coefficient Kx and vertical swing coefficient Ky or swiveling swing coefficient Kz at step S320, and then proceeds to step S330.

Control device 33 sets notch depth coefficient δx and notch depth coefficient δy or notch depth coefficient δz to a value close to 0 based on the computed ratio between notch depth coefficient δx and notch depth coefficient δy or notch depth coefficient δz in order to prioritize the vibration reducing effect at step S330, and then proceeds to step S340.

Control device 33 applies set notch depth coefficient δx to transfer function H(s) of notch filter Fx(n) to generate notch filter Fx(n2), and applies set notch depth coefficient δy or notch depth coefficient δz to corresponding transfer function H(s) of notch filter Fy(n) or notch filter Fz(n) to generate notch filter Fy(n4) or notch filter Fz(n4) at step S340, and then proceeds to step S350.

Control device 33 determines at step S350 whether or not the manual control is being carried out.

When a result of the determination indicates that the manual control is being carried out, control device 33 proceeds to step S360.

On the other hand, when the manual control is not being carried out, control device 33 proceeds to step S370.

Control device 33 applies, to control signal C(n) generated by a single manipulation tool, notch filter Fx(n2) and notch filter Fy(n4) or notch filter Fz(n4) corresponding to control signal C(n) to generate filtered control signal Cd(n), and applies, to control signal C(n+1) generated by another manipulation tool, notch filter Fx(n2) and notch filter Fy(n4) or notch filter Fz(n4) corresponding to control signal C(n+1) to generate filtered control signal Cd(n+1) at step S360, ends application step B of applying notch filter Fx(n2) and notch filter Fy(n4) or notch filter Fz(n4), and then proceeds to step S130.

Control device 33 applies, to control signal C(na) for the automatic control by a single manipulation tool, notch filter Fx(n2) and notch filter Fy(n4) or notch filter Fz(n4) corresponding to control signal C(na) to generate filtered control signal Cd(na), and applies, to control signal C(na+1) for the automatic control by another manipulation tool, notch filter Fx(n2) and notch filter Fy(n4) or notch filter Fz(n4) corresponding to control signal C(na+1) to generate filtered control signal Cd(na+1) at step S370, ends application step B of applying notch filter Fx(n2) and notch filter Fy(n4) or notch filter Fz(n4), and then proceeds to step S130.

As described above, in the case of the manual control in which the manipulability of the manipulation tool is to be prioritized, crane 1 applies to control signal C(n) notch filter Fx(n1) and notch filter Fy(n3) computed according to the ratio between lateral swing coefficient Kx and vertical swing coefficient Ky, so that it is possible to reduce the swing at resonance frequency ωx(n) of load W and the swing at natural frequency ωy(n) of telescopic boom 9 in the luffing direction to such an extent that the manipulability can be kept. Moreover, in the case of simultaneous manipulation of a plurality of manipulation tools as well as in the case of the automatic control in which the vibration reducing effect is to be prioritized, such as in an automatic stop control, an automatic carriage control, and/or the like required due to restrictions of a working region, crane 1 applies to control signal C(n) notch filter Fx(n2) and notch filter Fy(n4) computed according to the luffing angle of telescopic boom 9, so that it is possible to enhance the effect of reducing the swing at resonance frequency ωx(n) of load W and the swing at natural frequency ωz(n) telescopic boom 9 in the swiveling direction. In addition, when the emergency stop signal is generated by manipulation with a manipulation tool, switching to the vibration control for prioritizing the manipulability takes place. That is, crane 1 is configured such that control device 33 selectively switches the notch filter applied to control signal C(n) depending on the manipulation state of the manipulation tool and the luffing angle of telescopic boom 9. It is thus possible to reduce, depending on the operational state of crane 1, the vibration that is caused in the load and is related to resonance frequency ωx(n) of the pendulum and the vibration that is caused in the load and is related to natural frequency ωy(n) of telescopic boom 9 in the luffing direction.

The embodiment described above showed only a typical form, and can be variously modified and carried out within the range without deviation from the main point of one embodiment. Further, it is needless to say that the present invention can be carried out in various forms, and the scope of the present invention is indicated by the descriptions of the claims, and includes the equivalent meanings of the descriptions of the claims and every change within the scope.

INDUSTRIAL APPLICABILITY

The present invention can be utilized for cranes that attenuate a resonance frequency component of a control signal.

REFERENCE SIGNS LIST

1 Crane
8 Hydraulic swivel motor
12 Hydraulic luffing cylinder
14 Main wire rope
16 Sub wire rope
18 Swivel manipulation tool
19 Luffing manipulation tool
33 Control device
Lm(n) Suspension length of main wire rope
Ls(n) Suspension length of sub wire rope ωx(n) Resonance frequency of load ωy(n) Natural frequency of telescopic boom in luffing direction ωz(n) Natural frequency of telescopic boom in swiveling direction C(n) Control signal Cd(n) Filtered control signal

The invention claimed is:

1. A crane comprising:

a crane device that hoists up a load with a wire rope;

an actuator that operates the crane device;

a manipulator tool that receives an input operation by an operator; and a controller that controls the actuator based on an operation signal from the manipulator tool, wherein the crane device includes:

a telescopic boom being configured to support the wire rope such that the load can be hoisted; and a swivel base being configured to support the telescopic boom and to swivel, and wherein the controller generates a control signal based on the operation signal, computes a resonance frequency of a swing of a load in a horizontal direction based on a suspension length of a wire rope via which the load is suspended from a leading end of a telescopic boom, computes a natural frequency of the telescopic boom in a luffing direction, and generates a filtered control signal for the actuator by attenuating frequency components in any frequency range for the control signal according to a luffing manipulation of the telescopic boom, the frequency components including a frequency component in any frequency range is with reference to the resonance frequency of the load and a frequency component in any frequency range with reference to the natural frequency of the telescopic boom in the luffing direction.

2. The crane according to claim 1, wherein the controller changes the rate of attenuation of a frequency component in any frequency range with reference to the resonance frequency of the load and the rate of attenuation of a frequency component in any frequency range with reference to the natural frequency of the telescopic boom in the luffing direction based on a ratio between a coefficient of a swing in the horizontal direction and a coefficient of a swing in the luffing direction, the coefficient of the swing in the horizontal direction being a value obtained by dividing a luffed-up angle of the telescopic boom by the resonance frequency and the coefficient of the swing in the luffing direction being a value obtained by dividing a luffed-down angle of the telescopic boom by the natural frequency of the telescopic boom in the luffing direction.

3. A crane comprising:

a crane device that hoists up a load with a wire rope;

an actuator that operates the crane device;

a manipulator tool that receives an input operation by an operator; and a controller that controls the actuator based on an operation signal from the manipulator tool, wherein the crane device includes:

a telescopic boom being configured to support the wire rope such that the load can be hoisted; and a swivel base being configured to support the telescopic boom and to swivel, wherein the controller generates a control signal based on the operation signal, computes a resonance frequency of a swing of a load in a horizontal direction based on a suspension length of a wire rope via which the load is suspended from a leading end of a telescopic boom, computes a natural frequency of the telescopic boom in a swiveling direction, and generates a filtered control signal for the actuator by attenuating frequency components in any frequency range for the control signal according to a swivel manipulation of the telescopic boom, the frequency components including a frequency component with reference to the resonance frequency of the load and a frequency component with reference to the natural frequency of the telescopic boom in the swiveling direction.

4. The crane according to claim 3, wherein the controller changes the rate of attenuation of a frequency component in any frequency range with reference to the resonance frequency of the load and the rate of attenuation of a frequency component in any frequency range with reference to the natural frequency of the telescopic boom in the swiveling direction based on a ratio between a coefficient of a swing in the horizontal direction and a coefficient of a swing in a swiveling direction, the coefficient of the swing in the horizontal direction being a value obtained by dividing a luffed-up angle of the telescopic boom by the resonance frequency and the coefficient of the swing in the swiveling direction being a value obtained by dividing a luffed-up angle of the telescopic boom by the natural frequency of the telescopic boom in the swiveling direction.

* * * * *